US009568875B2

(12) United States Patent
Tashiro

(10) Patent No.: US 9,568,875 B2
(45) Date of Patent: Feb. 14, 2017

(54) IMAGE FORMING APPARATUS HAVING A REPLACEMENT UNIT AND A POWER SUPPLY SWITCH THAT IS TURNED OFF WHEN DETACHMENT OF THE REPLACEABLE UNIT IS NECESSARY

(71) Applicant: KYOCERA Document Solutions Inc., Osaka-shi, Osaka (JP)

(72) Inventor: Masaya Tashiro, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/496,098

(22) Filed: Sep. 25, 2014

(65) Prior Publication Data

US 2015/0093138 A1 Apr. 2, 2015

(30) Foreign Application Priority Data

Sep. 27, 2013 (JP) ..... 2013-201027

(51) Int. Cl.
*G03G 15/08* (2006.01)
*G03G 15/00* (2006.01)

(52) U.S. Cl.
CPC ..... *G03G 15/55* (2013.01); *G03G 15/0863* (2013.01); *G03G 15/5004* (2013.01); *G03G 15/553* (2013.01)

(58) Field of Classification Search
CPC .. G03G 15/5004; G03G 15/553; G03G 15/55; G03G 15/0863

(Continued)

(56) References Cited

U.S. PATENT DOCUMENTS

2005/0254841 A1* 11/2005 Tomitaka ..... G03G 15/0872 399/12
2008/0228968 A1* 9/2008 Aihara ..... G03G 15/5004 710/66

(Continued)

FOREIGN PATENT DOCUMENTS

JP S61237376 A 10/1986
JP 7-122332 5/1995

(Continued)

OTHER PUBLICATIONS

Japanese Office Action Dated Jan. 5, 2016.

*Primary Examiner* — Walter L Lindsay, Jr.
*Assistant Examiner* — Philip Marcus T Fadul
(74) *Attorney, Agent, or Firm* — Gerald E. Hespos; Michael J. Porco; Matthew T. Hespos

(57) ABSTRACT

An image forming apparatus includes a notifier, a power source, a first replaceable unit, a first body connector, a power supply switch, a detachment necessity determiner for determining whether the first replaceable unit needs to be detached, and a power supply controller. The first body connector includes a body power terminal and allows the first replaceable unit to be detachably connected thereto. The first replaceable unit includes a unit connector and an operation portion. The unit connector is connected to the body power terminal for supplying a power voltage to the operation portion. When the first replaceable unit is determined necessary to be detached, the power supply controller causes the power supply switch to turn off supply of the power source voltage from the power source to the body power terminal and causes the notifier to provide a notification recommending detachment of the first replaceable unit.

4 Claims, 14 Drawing Sheets

(58) Field of Classification Search
USPC ..... 399/90
See application file for complete search history.

(56) References Cited

U.S. PATENT DOCUMENTS

| | | | | |
|---|---|---|---|---|
| 2009/0016763 | A1* | 1/2009 | Nakamura | G03G 15/5004 399/90 |
| 2010/0150581 | A1 | 6/2010 | Nakamua | |
| 2011/0052218 | A1 | 3/2011 | Arai | |
| 2012/0056954 | A1* | 3/2012 | Asauchi | B41J 2/17513 347/86 |

FOREIGN PATENT DOCUMENTS

| | | | |
|---|---|---|---|
| JP | 10-333794 | | 12/1998 |
| JP | 2010145448 | A | 7/2010 |
| JP | 2011048015 | A | 3/2011 |

* cited by examiner

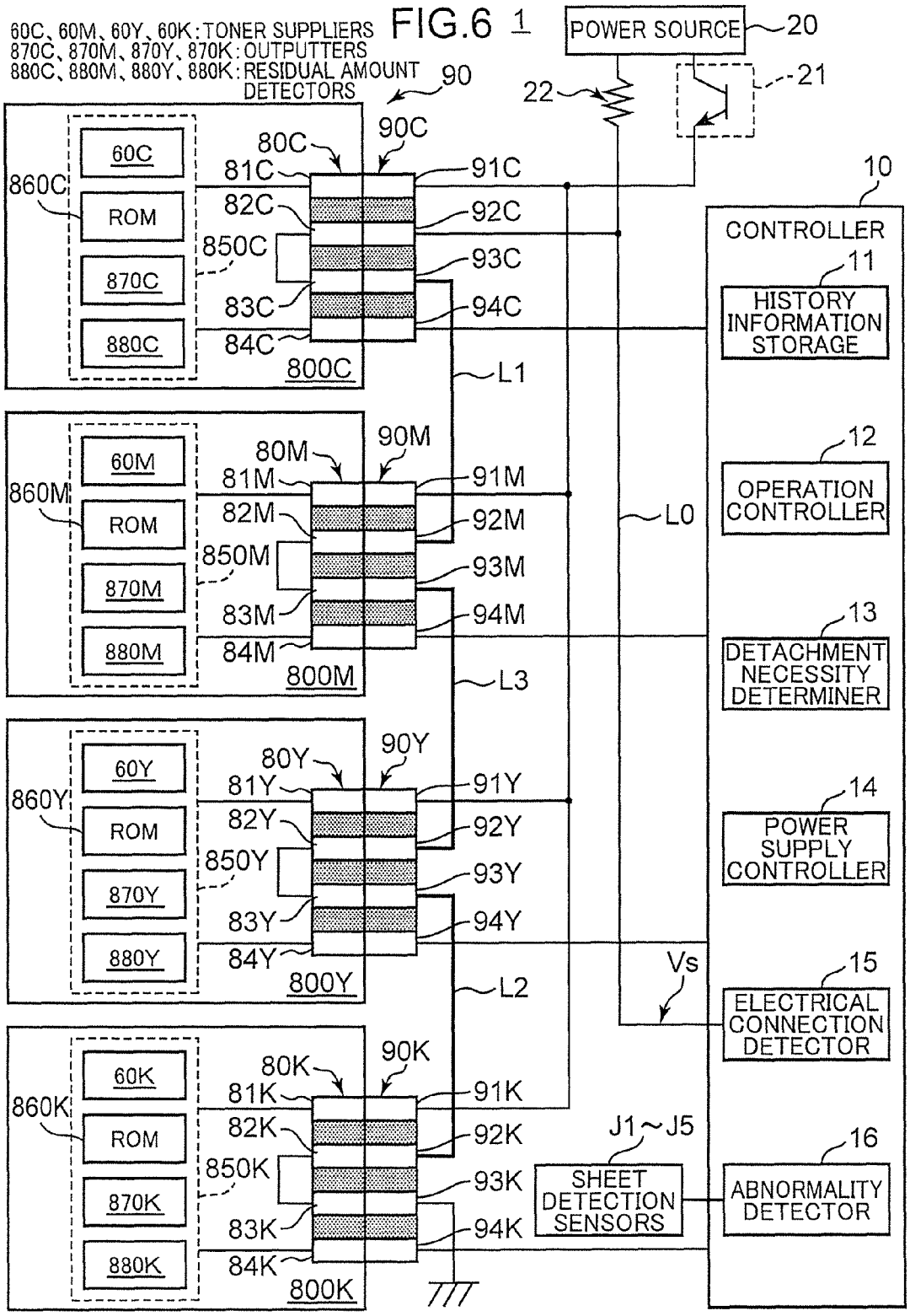
FIG.6
1
60C、60M、60Y、60K:TONER SUPPLIERS
870C、870M、870Y、870K:OUTPUTTERS
880C、880M、880Y、880K:RESIDUAL AMOUNT DETECTORS
90
POWER SOURCE
20
21
22
10
CONTROLLER
11
HISTORY INFORMATION STORAGE
12
OPERATION CONTROLLER
13
DETACHMENT NECESSITY DETERMINER
14
POWER SUPPLY CONTROLLER
15
ELECTRICAL CONNECTION DETECTOR
16
ABNORMALITY DETECTOR
60C
ROM
870C
880C
860C
80C
90C
81C
82C
850C
83C
84C
91C
92C
93C
94C
800C
L1
60M
ROM
870M
880M
860M
80M
90M
81M
82M
850M
83M
84M
91M
92M
93M
94M
800M
L3
L0
60Y
ROM
870Y
880Y
860Y
80Y
90Y
81Y
82Y
850Y
83Y
84Y
91Y
92Y
93Y
94Y
800Y
L2
Vs
60K
ROM
870K
880K
860K
80K
90K
81K
82K
850K
83K
84K
91K
92K
93K
94K
800K
J1~J5
SHEET DETECTION SENSORS

IMAGE FORMING APPARATUS HAVING A REPLACEMENT UNIT AND A POWER SUPPLY SWITCH THAT IS TURNED OFF WHEN DETACHMENT OF THE REPLACEABLE UNIT IS NECESSARY

This application is based on Japanese Patent Application No. 2013-201027 filed with the Japan Patent Office on Sep. 27, 2013, the contents of which are hereby incorporated by reference.

BACKGROUND

The present disclosure relates to an image forming apparatus and, in particular, to a technique of controlling power supply to a replaceable unit mounted in the image forming apparatus when the replaceable unit is dismounted from the image forming apparatus.

Conventionally, it has been known that a replaceable component having a life cycle, such as a toner container and a developer, is constituted into a replaceable unit which is detachable in an image forming apparatus. When a replaceable component terminates the life, the image forming apparatus informs a user of the state of the replaceable component. This allows the user to perform a replacement. The replacement includes detaching a specific replaceable unit having the replaceable component terminating the life, and attaching a new replaceable unit to the apparatus body.

However, if the user detaches the replaceable unit under supply of a power source voltage, a so-called surge voltage is likely to occur instantaneously in the connection between the replaceable unit and the apparatus body. This causes flow of a large current into the replaceable unit, which may damage the replaceable unit.

Accordingly, there is known a technique of providing a ground pin longer than a power source pin in a connector for attaching an input/output device thereto, for example. According to this technique, when the input/output device is detached from the connector, the power source pin is disconnected before the ground pin. This allows a current caused by the occurrence of a surge voltage at the power source pin to flow to the ground when the input/output device is detached from the connector.

In addition, there is known a technique of providing a spiral spring around a pin header. According to this technique, when the pin header is detached from a socket receptacle, the spiral spring exerts a biasing force to cause the pin header to be detached quickly from the socket receptacle. Therefore, the connection between the pin header and the socket receptacle can be prevented from being damaged by the occurrence of spark discharge in the connection.

SUMMARY

An image forming apparatus according to the present disclosure includes a notifier, a power source, a first replaceable unit, a first body connector, a power supply switch, a detachment necessity determiner, and a power supply controller. The notifier provides a notification. The power source generates a power source voltage. The first replaceable unit performs a specific operation by means of the power source voltage. The first body connector includes a body power terminal connected to the power source and allows the first replaceable unit to be detachably connected thereto. The power supply switch turns on and off supply of the power source voltage from the power source to the body power terminal. The detachment necessity determiner determines whether the first replaceable unit needs to be detached. The power supply controller controls operations of the power supply switch and the notifier. The first replaceable unit includes a unit connector to be detachably connected to the first body connector, and an operation portion for performing the specific operation by means of the power supply voltage. The unit connector includes a unit power terminal to be connected to the body power terminal for supplying the power voltage to the operation portion. When the detachment necessity determiner determines that the first replaceable unit needs to be detached, the power supply controller causes the power supply switch to turn off supply of the power source voltage from the power source to the body power terminal and causes the notifier to provide a notification recommending detachment of the first replaceable unit.

These and other objects, features and advantages of the present disclosure will become more apparent upon reading the following detailed description along with the accompanying drawings.

BRIEF DESCRIPTION OF THE DRAWINGS

FIG. 6 is a block diagram showing a configuration of a portion related to replaceable units including a toner supplier in the copier.

DETAILED DESCRIPTION

First Embodiment

Hereinafter, an embodiment of the present disclosure will be described with reference to the accompanying drawings.

Figure 1:
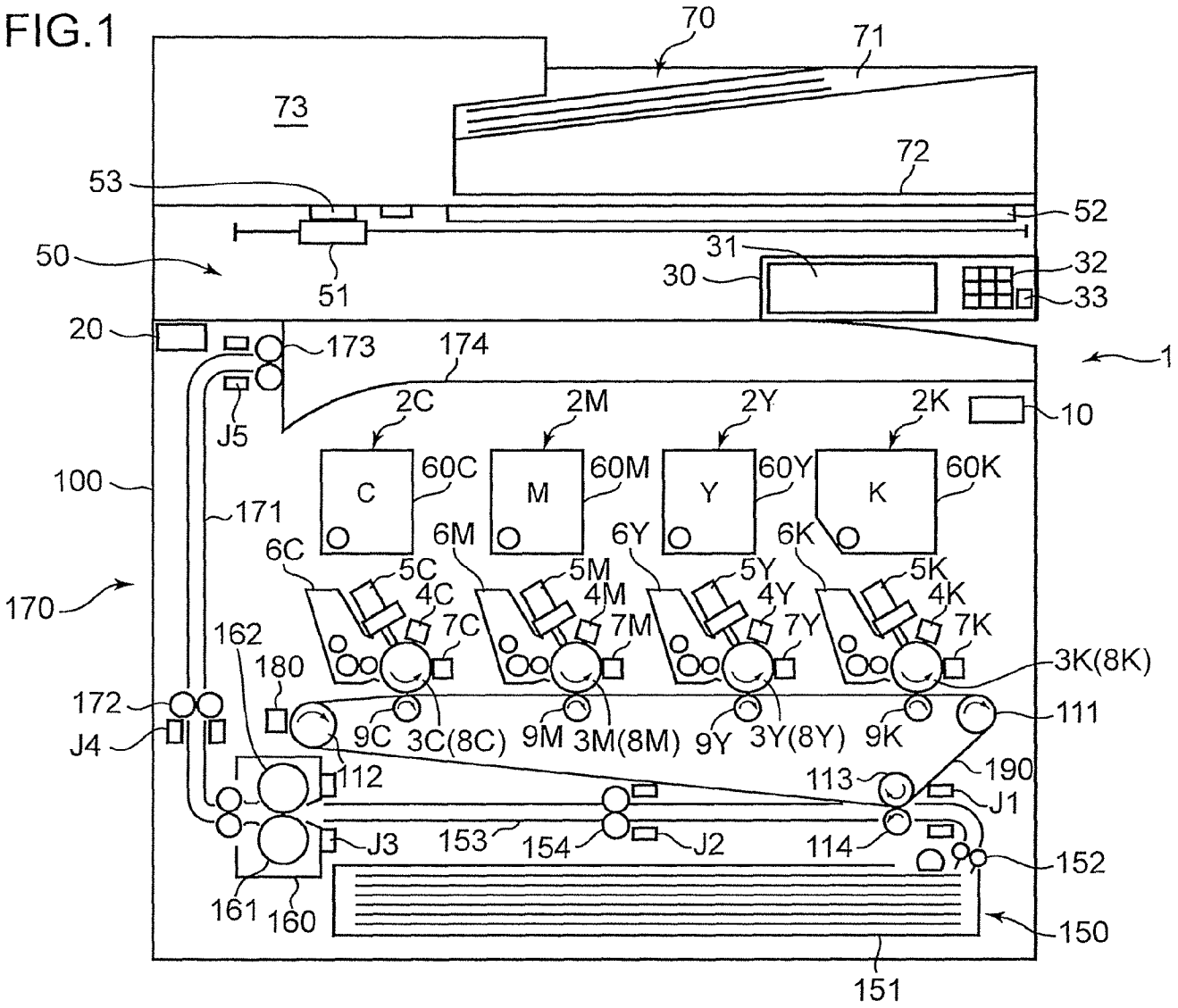
FIG. 1 is a schematic configuration diagram of a copier as an embodiment of an image forming apparatus according to the present disclosure.

FIG. 1 is a schematic configuration diagram of a copier 1 as an embodiment of an image forming apparatus according to the present disclosure.

As shown in FIG. 1, the copier 1 includes an operation section 30, a document reading section 50, a document feeding section 70, and a main body 100.

The operation section 30 includes a display 31 (notifier) for displaying a message, an operation key portion 32 for allowing a user to input various operation instructions, and a speaker 33 (notifier). The display 31 includes a liquid crystal display having a touch panel function, for example. The operation key portion 32 includes various types of switch keys. For example, the operation key portion 32 includes a start key for allowing a user to input an instruction for executing printing, a numerical keypad for allowing a user to set the number of copies, and the like. The speaker 33 is a device for outputting a predetermined sound in accordance with an instruction received from a controller 10 to be described later.

The document reading section 50 includes a scanner 51 having an exposure lamp, a CCD (Charge Coupled Device) and the like, a document table 52 made of a transparent member such as glass, and a document reading slit 53.

The scanner 51 is movable by an unillustrated driving section. In the case of reading an original document placed on the document table 52, the scanner 51 moves along a document surface at a position opposite to the document table 52. Subsequently, the scanner 51 acquires image data representing an image of the original document while scanning the original document, and outputs the acquired image data to the controller 10 to be described later. In addition, in the case of reading an original document fed by the document feeding section 70, the scanner 51 moves at a position opposite to the document reading slit 53. Subsequently, the scanner 51 acquires image data representing an image of the original document through the document reading slit 53 in synchronization with document conveyance by the document feeding section 70, and outputs the acquired image data to the controller 10 to be described later.

The document feeding section 70 includes a document mounting portion 71 for allowing original documents to be placed thereon, a document discharge portion 72 for receiving an original document having been subjected to image reading and discharged thereto, and a document conveyer 73. The document conveyer 73 delivers original document sheets placed on the document mounting portion 71 one by one to the position opposite to the document reading slit 53, and discharges it onto the document discharge portion 72.

The main body 100 includes image forming sections 2C, 2M, 2Y, and 2K, a sheet feeding section 150, a fixing section 160, a discharge section 170, a static eliminating cleanerl 80, the controller 10, and a power source 20.

The image forming sections 2C, 2M, 2Y, and 2K form images in the colors of cyan (C), magenta (M), yellow (Y), and black (K), respectively. The image forming section 2C includes a replaceable unit 8C, a charger 4C, an exposure portion 5C, a toner supplier 60C, a developer 6C, and a cleaner 7C. Similarly, the image forming section 2M includes a replaceable unit 8M, a charger 4M, an exposure portion 5M, a toner supplier 60M, a developer 6M, and a cleaner 7M. The image forming section 2Y includes a replaceable unit 8Y, a charger 4Y, an exposure portion 5Y, a toner supplier 60Y, a developer 6Y, and a cleaner 7Y. The image forming section 2K includes a replaceable unit 8K, a charger 4K, an exposure portion 5K, a toner supplier 60K, a developer 6K, and a cleaner 7K.

There is provided an unillustrated cover on the front side of the main body 100 shown in FIG. 1. Each of the replaceable units 8C, 8M, 8Y, and 8K is attached to and detached from the main body 100 by opening the cover. The replaceable units 8C, 8M, 8Y and 8K include photoreceptor drums 3C, 3M, 3Y, and 3K, respectively.

Hereinafter, the image forming sections 2C, 2M, 2Y, and 2K will be generalizedly referred to as image forming sections 2 in the description of their common feature. The photoreceptor drums 3C, 3M, 3Y, and 3K will be generalizedly referred to as photoreceptor drums 3 in the description of their common feature. The chargers 4C, 4M, 4Y, and 4K will be generalizedly referred to as chargers 4 in the description of their common feature. The exposure portions 5C, 5M, 5Y, and 5K will be generalizedly referred to as exposure portions 5 in the description of their common feature. The toner suppliers 60C, 60M, 60Y, and 60K will be generalizedly referred to as toner suppliers 60 in the description of their common feature. The developers 6C, 6M, 6Y, and 6K will be generalizedly referred to as developers 6 in the description of their common feature. The cleaners 7C, 7M, 7Y and 7K will be generalizedly referred to as cleaners 7 in the description of their common feature.

Each of the photoreceptor drums 3C, 3M, 3Y and 3K or the photoreceptor drum 3 has a surface laminated with a photosensitive layer made of amorphous silicon, for example. The photoreceptor drum 3 is rotated by an unillustrated motor.

Each of the chargers 4C, 4M, 4Y, and 4K or the charger 4 uniformly charges the entire surface of the corresponding photoreceptor drum 3 in rotation to a specific potential. Each of the exposure portions 5C, 5M, 5Y, and 5K or the exposure portion 5 irradiates the surface of the corresponding photoreceptor drum 3 with laser light in accordance with image data received by the controller 10, under control of the controller 10. This leads to formation of an electrostatic latent image on the surface of the photoreceptor drum 3.

The toner suppliers 60C, 60M, 60Y, and 60K contain toner for each of the colors cyan (C), magenta (M), yellow (Y), and black (K), respectively. Each of the tonner suppliers 60C, 60M, 60Y, and 60K or the toner supplier 60 includes an unillustrated screw feeder which is rotated to convey toner. This allows toner to be supplied to the corresponding one of the developers 6C, 6M, 6Y, and 6K or developer 6 through an unillustrated tonner supply port communicating with the developer 6.

The developer 6 includes an unillustrated developing roller disposed at a position opposite to the corresponding photoreceptor drum 3. The developer 6 causes the developing roller to rotate for allowing toner supplied from the corresponding toner supplier 60 to be carried on the circumferential surface of the developing roller. Subsequently, the developer 6 causes the toner carried on the circumferential surface of the developing roller to be adhered to an electrostatic latent image formed on the corresponding photoreceptor drum 3. This leads to development of the electrostatic latent image into a toner image.

Each of the cleaners 7C, 7M, 7Y and 7K or the cleaner 7, after the end of a primary transfer of a toner image onto an intermediate belt 190 to be described later, removes toner that has not been transferred onto the intermediate belt 190 and remains on the surface of the corresponding photoreceptor drum 3.

There are primary transfer rollers 9C, 9M, 9Y, and 9K disposed under the image forming sections 2C, 2M, 2Y, and 2K, respectively. The intermediate belt 190 is disposed under the image forming sections 2C, 2M, 2Y, and 2K. The primary transfer rollers 9C, 9M, 9Y, and 9K and the intermediate belt 190 perform a primary transfer of toner images of the respective colors developed on the surfaces of the photoreceptor drums 3C, 3M, 3Y, and 3K.

The intermediate belt 190 is pressed against the photoreceptor drums 3C, 3M, 3Y, and 3K by the primary transfer rollers 9C, 9M, 9Y, and 9K disposed oppositely to the photoreceptor drums 3C, 3M, 3Y, and 3K, respectively. In this state, the intermediate belt 190, which is endless, is rotated by driving rollers 111, 112, and 113.

Toner images of the respective colors formed on the photoreceptor drums 3C, 3M, 3Y, and 3K are transferred onto the intermediate belt 190 in rotation, in the order of cyan, magenta, yellow, and black in a super imposing manner. This leads to formation of a four-color image in cyan, magenta, yellow, and black on the intermediate belt 190.

There is a secondary transfer roller 114 disposed at a position opposite to the driving roller 113 across the intermediate belt 190. The secondary transfer roller 114 transfers a color image transferred onto the intermediate belt 190 onto a sheet.

The sheet feeding section 150 includes a sheet feeding cassette 151 for storing sheets, a sheet feeding roller 152, a conveyance passage 153 defining a path for conveying a sheet, and a conveyance roller 154. The sheet feeding roller 152 picks up sheets one by one from the sheet feeding cassette 151, and conveys the picked up sheet to the secondary transfer roller 114. The conveyance roller 154 conveys a sheet having a color image transferred thereon by the secondary transfer roller 114 to the fixing section 160 along the conveyance passage 153.

The fixing section 160 is disposed downstream of the secondary transfer roller 114 in the conveyance passage 153. The fixing section 160 includes a heating roller 161 and a pressing roller 162. The heating roller 161 is heated by an unillustrated heater to melt toner on a sheet by the heat. The pressing roller 162 is disposed oppositely to the heating roller 161. The heating roller 162 exerts a pressure to a sheet passing through a nip between the heating roller 161 and the pressing roller 162. This leads to fixation of toner melted by the heating roller 161 onto the sheet.

The discharge section 170 includes a conveyance passage 171 defining a path for conveying a sheet, a conveyance roller 172, a discharge roller 173, and a discharge tray 174. The conveyance roller 172 conveys a sheet having toner fixed thereon by the fixing section 160 to the discharge roller 173 along the conveyance passage 171. The discharge roller 173 discharges a sheet having been conveyed by the conveyance roller 172 onto the discharge tray 174.

The static eliminating cleaner 180 removes toner remaining on the intermediate belt 190. The static eliminating cleaner 180 includes unillustrated cleaning electrode and cleaning brush, for example. The static eliminating cleaner 180 uses the cleaning electrode to exert a cleaning bias to the cleaning brush, the cleaning bias having an opposite polarity to that of electric charge of toner. This leads to generation of an electrostatic force to move the toner on the intermediate belt 190 to the cleaning brush. In this manner, the static eliminating cleaner 180 removes the toner.

A sheet detection sensor J1 is provided in the vicinity of the upstream side of the driving roller 113 and the secondary transfer roller 114 in a sheet conveyance direction. The sheet detection sensor J1 includes a light transmission sensor, for example. Upon detection of arrival of a tip end of a sheet, the sheet detection sensor J1 outputs to the controller 10 a signal indicating that the sheet has arrived at the driving roller 113 and the secondary transfer roller 114.

A sheet detection sensor J2 is provided in the vicinity of the upstream side of the conveyance roller 154 in the sheet conveyance direction. The sheet detection sensor J2 includes a light transmission sensor, for example. Upon detection of arrival of a tip end of a sheet, the sheet detection sensor J2 outputs to the controller 10 a signal indicating that the sheet has arrived at the conveyance roller 154.

A sheet detection sensor J3 is provided in the vicinity of the upstream side of the heating roller 161 and the pressing roller 162 in the sheet conveyance direction. The sheet detection sensor J3 includes a light transmission sensor, for example. Upon detection of arrival of a tip end of a sheet, the sheet detection sensor J3 outputs to the controller 10 a signal indicating that the sheet has arrived at the heating roller 161 and the pressing roller 162.

A sheet detection sensor J4 is provided in the vicinity of the upstream side of the conveyance roller 172 in the sheet conveyance direction. The sheet detection sensor J4 includes a light transmission sensor, for example. Upon detection of arrival of a tip end of a sheet, the sheet detection sensor J4 outputs to the controller 10 a signal indicating that the sheet has arrived at the conveyance roller 172.

A sheet detection sensor J5 is provided in the vicinity of the upstream side of the discharge roller 173 in the sheet conveyance direction. The sheet detection sensor J5 includes a light transmission sensor, for example. Upon detection of arrival of a tip end of a sheet, the sheet detection sensor J5 outputs to the controller 10 a signal indicating that the sheet has arrived at the discharge roller 173.

The controller 10 controls operations of the entire copier 1. The controller 10 includes, for example, a CPU (Central Processing Unit) for executing predetermined arithmetic processing, a non-volatile memory such as EEPROM (Electrically Erasable and Programmable Read Only Memory) storing a predetermined control program, a RAM (Random Access Memory) for temporarily storing data, and peripheral circuits.

The power source 20 uses an unillustrated AC/DC converter to convert an AC voltage supplied from an AC power source such as commercial power source into a DC voltage having a specific voltage value. This allows the power source 20 to generate a power source voltage to be used for the operation of each of the image forming sections 2, the chargers 4, the exposure portions 5, the developers 6, the cleaners 7, and the sheet detection sensors J1 to J5.

Figure 2:
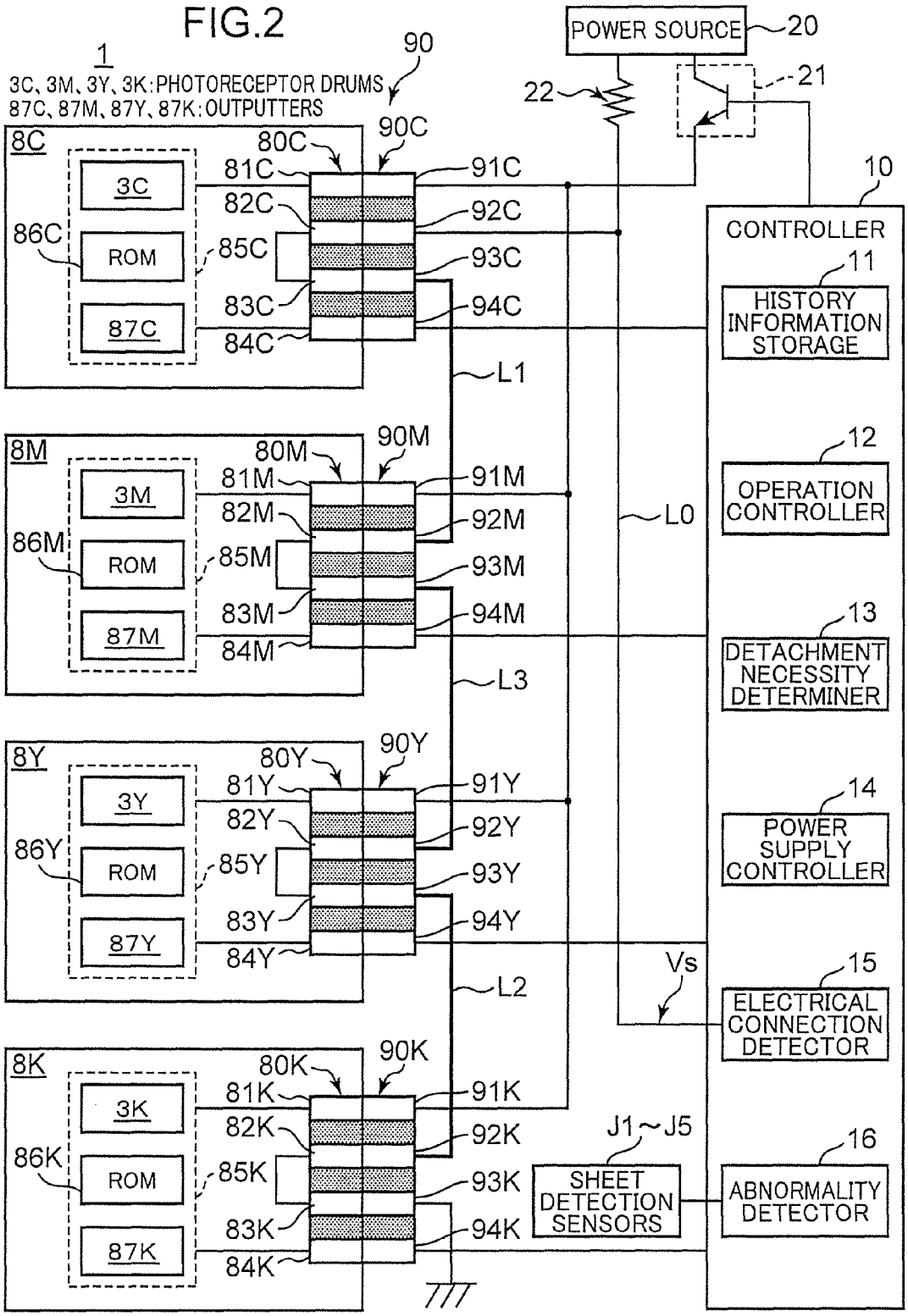
FIG. 2 is a block diagram showing a configuration of a portion related to replaceable units in the copier.

Now a configuration for attaching a replaceable unit 8C (8M, 8Y, 8K) to the copier 1 will be described in detail. FIG. 2 is a block diagram showing a configuration of a portion related to the replaceable units 8C, 8M, 8Y and 8K in the copier 1.

The copier 1 includes the replaceable units 8C (first replaceable unit), 8M (third replaceable unit), 8Y (third replaceable unit), and 8K (second replaceable unit), body connectors 90C (first body connector), 90M (third body connector), 90Y (third body connector), and 90K (second body connector) for respectively allowing the replaceable units 8C, 8M, 8Y and 8K to be detachably connected thereto, a power supply switch 21 (power supply switch), a resistor 22, the power source 20, the sheet detection sensors J1 to J5, and the controller 10 as shown in FIG. 2, for example. The body connectors 90C, 90M, 90Y, and 90K constitute a body connection section 90.

The sheet detection sensors J1 to J5 are supplied with a power source voltage from the power source 20 through an unillustrated feeder. The controller 10 is also supplied with a power source voltage from the power source 20 through an unillustrated feeder.

The replaceable unit 8C includes a unit connector 80C (unit connector) and an internal block 85C. The internal block 85C includes the photoreceptor drum 3C (operation portion), a ROM 86C (reference information storage), and an outputter 87C.

The unit connector 80C includes a power terminal 81C (unit power terminal), a first connection terminal 82C (first unit connection terminal), a second connection terminal 83C (second unit connection terminal), and a signal terminal 84C. The unit connector 80C is detachably connectable to the body connector 90C.

The power terminal 81C is connected to a power terminal 91C to be described later which is included in the body connector 90C. The power terminal 81C receives a power source voltage supplied from the power terminal 91C. The first connection terminal 82C and the second connection terminal 83C are connected to each other at their respective ends opposite to those connected to the body connector 90C, to be electrically connected to each other. The signal terminal 84C is connected to a signal terminal 94C to be described later which is included in the body connector 90C, to transmit a signal outputted from the outputter 87C to the signal terminal 94C.

The photoreceptor drum 3C is rotated by the unillustrated motor. The motor operates by using a power source voltage received by the power terminal 81C.

The ROM 86C stores reference information serving as a reference for determining whether the photoreceptor drum 3C needs to be replaced. The reference information includes, for example, information indicating a maximum expected operating time during which the photoreceptor drum 3C is rotated. The maximum expected operating time is predetermined by the specifications of the photoreceptor drum 3C.

The outputter 87C reads reference information stored in the ROM 86C and outputs a signal representing the reference information to the signal terminal 84C.

The body connector 90C includes the power terminal 91C (body power terminal), a first connection terminal 92C (first body connection terminal), a second connection terminal 93C (second body connection terminal), and the signal terminal 94C.

The power terminal 91C is connected to the power terminal 81C. The power terminal 91C has one end connected to the unit connector 80C and the other end connected to the power source 20 through the power supply switch 21.

The power supply switch 21 switches between an on-state mode for establishing electrical connection between the power source 20 and the power terminal 91C and an off-state mode for cutting off the electrical connection under control by a power supply controller 14 to be described later. The power supply switch 21 switches between the on-state mode and the off-state mode to thereby turn on and off supply of a power source voltage from the power source 20 to the power terminal 91C.

Specifically, when the power supply switch 21 is in the on-state mode, the power terminal 91C supplies a power source voltage generated by the power source 20 to the replaceable unit 8C through the power terminal 81C.

The first connection terminal 92C is connected to the first connection terminal 82C. The second connection terminal 93C is connected to the second connection terminal 83C.

The signal terminal 94C has one end connected to the signal terminal 84C and the other end connected to the controller 10. In other words, the signal terminal 94C outputs a signal transmitted from the signal terminal 84C to the controller 10.

The replaceable unit 8M has a similar configuration to that of the replaceable unit 8C, and includes a unit connector 80M and an internal block 85M. The internal block 85M includes the photoreceptor drum 3M, a ROM 86M, and an outputter 87M. The unit connector 80M has a similar configuration to that of the unit connector 80C, and includes a power terminal 81M, a first connection terminal 82M, a second connection terminal 83M, and a signal terminal 84M. The unit connector 80M is detachably connected to the body connector 90M.

The replaceable unit 8Y has a similar configuration to that of the replaceable unit 8C, and includes a unit connector 80Y and an internal block 85Y. The internal block 85Y includes the photoreceptor drum 3Y, a ROM 86Y, and an outputter 87Y. The unit connector 80Y has a similar configuration to that of the unit connector 80C, and includes a power terminal 81Y, a first connection terminal 82Y, a second connection terminal 83Y, and a signal terminal 84Y. The unit connector 80Y is detachably connected to the body connector 90Y.

The replaceable unit 8K has a similar configuration to that of the replaceable unit 8C, and includes a unit connector 80K and an internal block 85K. The internal block 85K includes the photoreceptor drum 3K, a ROM 86K, and an outputter 87K. The unit connector 80K has a similar configuration to that of the unit connector 80C, and includes a power terminal 81K, a first connection terminal 82K, a second connection terminal 83K, and a signal terminal 84K. The unit connector 80K is detachably connected to the body connector 90K.

The body connector 90M has a similar configuration to that of the body connector 90C, and includes a power terminal 91M, a first connection terminal 92M, a second connection terminal 93M, and a signal terminal 94M. The power terminal 91M is connected to the power source 20 through the power supply switch 21. When the power supply switch 21 is in the on-state mode, the power terminal 91M supplies a power source voltage generated by the power source 20 to the replaceable unit 8M through the power terminal 81M.

The body connector 90Y has a similar configuration to that of the body connector 90C, and includes a power terminal 91Y, a first connection terminal 92Y, a second connection terminal 93Y, and a signal terminal 94Y. The power terminal 91Y is connected to the power source 20 through the power supply switch 21. When the power supply switch 21 is in the on-state mode, the power terminal 91Y supplies a power source voltage generated by the power source 20 to the replaceable unit 8Y through the power terminal 81Y.

The body connector 90K has a similar configuration to that of the body connector 90C, and includes a power terminal 91K, a first connection terminal 92K, a second connection terminal 93K, and a signal terminal 94K. The power terminal 91K is connected to the power source 20 through the power supply switch 21. When the power supply switch 21 is in the on-state mode, the power terminal 91K supplies a power source voltage generated by the power source 20 to the replaceable unit 8K through the power terminal 81K.

The first connection terminal 92C has one end connected to the unit connector 80C and the other end connected to the controller 10 through a wire L0. The wire L0 is connected to the power source 20 through the resistor 22. The second connection terminal 93K, which is disposed farthest from the second connection terminal 93C, is connected to the ground at one end opposite to the other end connected to the unit connector 80K in the present embodiment. However, the second connection terminal 93K may be connected to another electrical element at the one end.

The copier 1 includes a wire L1 (first wire) connecting one end of the second connection terminal 93C opposite to the other end connected to the unit connector 80C and one end of the first connection terminal 92M opposite to the other end connected to the unit connector 80M.

The copier 1 includes a wire L3 connecting one end of the second connection terminal 93M opposite to the other end connected to the unit connector 80M and one end of the first connection terminal 92Y opposite to the other end connected to the unit connector 80Y.

The copier 1 includes a wire L2 (second wire) connecting one end of the second connection terminal 93Y opposite to the other end connected to the unit connector 80Y and one end of the first connection terminal 92K opposite to the other end connected to the unit connector 80K.

Therefore, when the unit connector 80C is attached to the body connector 90C, the power source 20 is electrically connected to the first connection terminal 92C, the first connection terminal 82C, the second connection terminal 83C, and the second connection terminal 93C in the order named, through the resistor 22. Further, the second connection terminal 93C and the first connection terminal 92M are electrically connected through the wire L1.

When the unit connector 80M is attached to the body connector 90M, there is established an electrical connection passing through the first connection terminal 92M, the first connection terminal 82M, the second connection terminal 83M, and the second connection terminal 93M in the order named. Further, the second connection terminal 93M and the first connection terminal 92Y are electrically connected through the wire L3.

When the unit connector 80Y is attached to the body connector 90Y, there is established an electrical connection passing through the first connection terminal 92Y, the first connection terminal 82Y, the second connection terminal 83Y, and the second connection terminal 93Y in the order named. Further, the second connection terminal 93Y and the first connection terminal 92K are electrically connected through the wire L2.

When the unit connector 80K is attached to the body connector 90K, there is established an electrical connection passing through the first connection terminal 92K, the first connection terminal 82K, the second connection terminal 83K, and the second connection terminal 93K to the ground in the order named.

Therefore, when all of the four unit connectors 80C, 80M, 80Y, and 80K are attached to the corresponding body connectors 90C, 90M, 90Y, and 90K, respectively, there is an electrical connection between the first connection terminal 92C and the second connection terminal 93K passing through all of the first connection terminals 92C, 92M, 92Y, and 92K, and the second connection terminals 93C, 93M, 93Y, and 93K included in the four body connectors 90C, 90M, 90Y, and 90K and all of the first connection terminals 82C, 82M, 82Y, and 82K and the second connection terminals 83C, 83M, 83Y, and 83K included in the four unit connectors 80C, 80M, 80Y, and 80K. Therefore, when any one of the four unit connectors 80C, 80M, 80Y, and 80K is not attached to the corresponding one of the body connectors 90C, 90M, 90Y, and 90K, the above-described electrical connection is likely to be broken at a certain location.

Hereinafter, the replaceable units 8C, 8M, 8Y, and 8K will be generalizedly referred to as replaceable units 8 in the description of their common feature.

The unit connectors 80C, 80M, 80Y, and 80K will be generalizedly referred to as unit connectors 80 in the description of their common feature. The internal blocks 85C, 85M, 85Y, and 85K will be generalizedly referred to as internal blocks 85 in the description of their common feature.

The power terminals 81C, 81M, 81Y, and 81K will be generalizedly referred to as power terminals 81 in the description of their common feature. The first connection terminals 82C, 82M, 82Y, and 82K will be generalizedly referred to as first connection terminals 82 in the description of their common feature. The second connection terminals 83C, 83M, 83Y, and 83K will be generalizedly referred to as second connection terminals 83 in the description of their common feature. The signal terminals 84C, 84M, 84Y, and 84K will be generalizedly referred to as signal terminals 84 in the description of their common feature. The ROMs 86C, 86M, 86Y, and 86K will be generalizedly referred to as ROMs 86 in the description of their common feature. The outputters 87C, 87M, 87Y, and 87K will be generalizedly referred to as outputters 87 in the description of their common feature.

The power terminals 91C, 91M, 91Y, and 91K will be generalizedly referred to as power terminals 91 in the description of their common feature. The first connection terminals 92C, 92M, 92Y, and 92K will be referred to as first connection terminals 92 in the description of their common feature. The second connection terminals 93C, 93M, 93Y, and 93K will be generalizedly referred to as second connection terminals 93 in the description of their common feature. The signal terminals 94C, 94M, 94Y, and 94K will be generalizedly referred to as signal terminals 94 in the description of their common feature.

The controller 10 uses a part of a storage area of the non-volatile memory to constitute a history information storage 11. The controller 10 executes control programs stored in the non-volatile memory to constitute an operation controller 12, a detachment necessity determiner 13, the power supply controller 14, an electrical connection detector 15, and an abnormality detector 16. Descriptions of the history information storage 11, the operation controller 12, the detachment necessity determiner 13, the power supply controller 14, and the electrical connection detector 15 will be provided later.

The abnormality detector 16 detects an occurrence of sheet jam in the sheet conveyance passages. Specifically, the abnormality detector 16 measures a time difference between respective time points when adjacent two of the five sheet detection sensors J1 to J5 (FIG. 1) detect arrival of a sheet. When a measured time difference is equal to or greater than a specific time which is set in advance according to a combination of the relevant two sheet detection sensors, the abnormality detector 16 detects an occurrence of sheet jam between the two sheet detection sensors. The specific time set in advance according to the combination of the two sheet detection sensors is equivalent to a time required for conveying a sheet between the two sheet detection sensors which is determined on the basis of results of trial operations, for example.

For example, the sheet detection sensor J1 (FIG. 1) detects arrival of a tip end of a sheet at a time point t1, and thereafter the sheet detection sensor J2 (FIG. 1) detects arrival of the tip end of the sheet at a time point t2. In this case, the abnormality detector 16 measures a time difference between the time points t1 and t2. If the measured time difference is equal to or greater than a specific time value that is set in advance according to a combination of the sheet detection sensors J1 and J2, namely, a time required for conveying a sheet between the sheet detection sensors J1 and J2, the abnormality detector 16 detects an occurrence of sheet jam between the sheet detection sensors J1 and J2.

Figure 3:
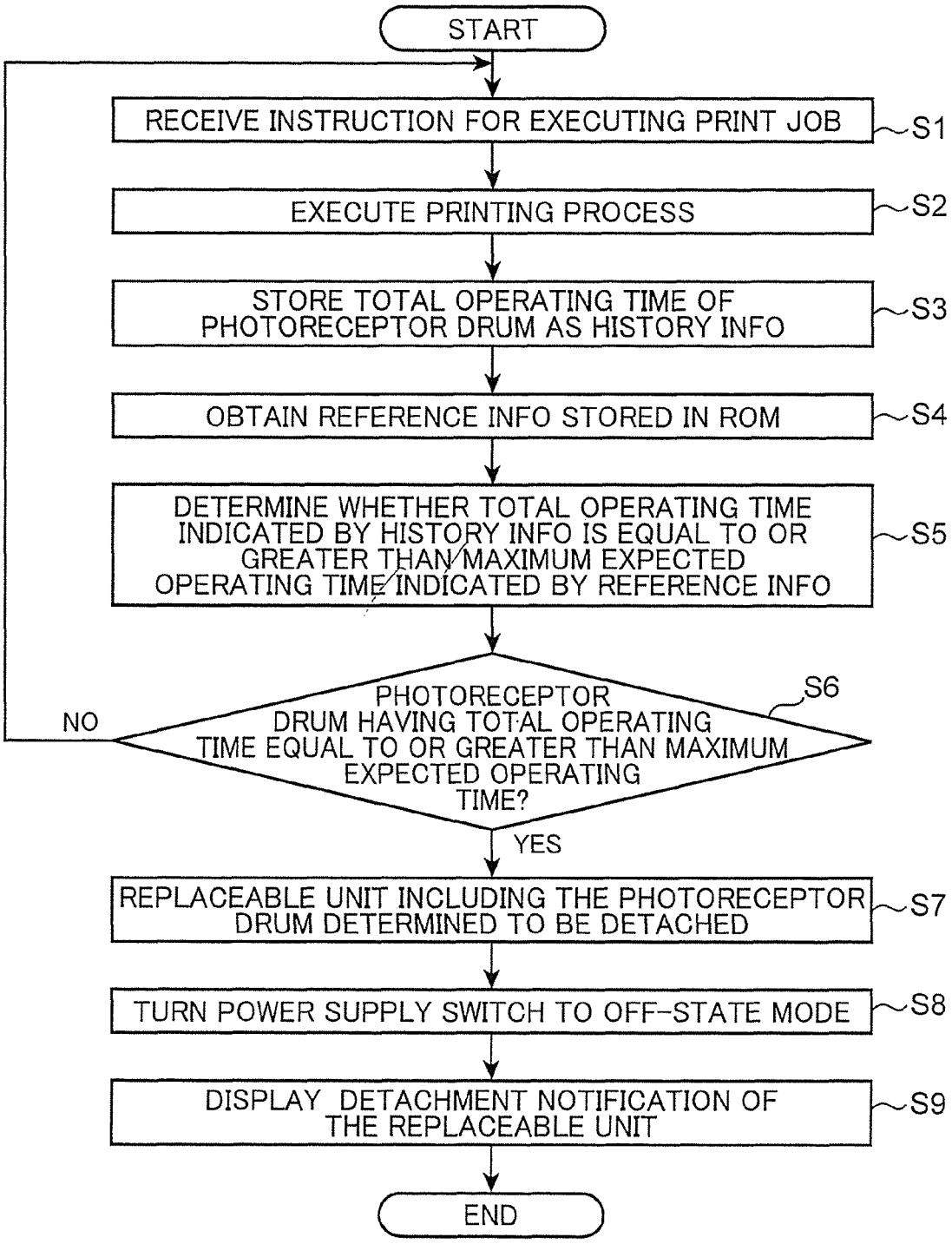
FIG. 3 is a flowchart showing an operation of the copier performed for the detachment of one of the replaceable units from the copier by a user.
Figure 4:
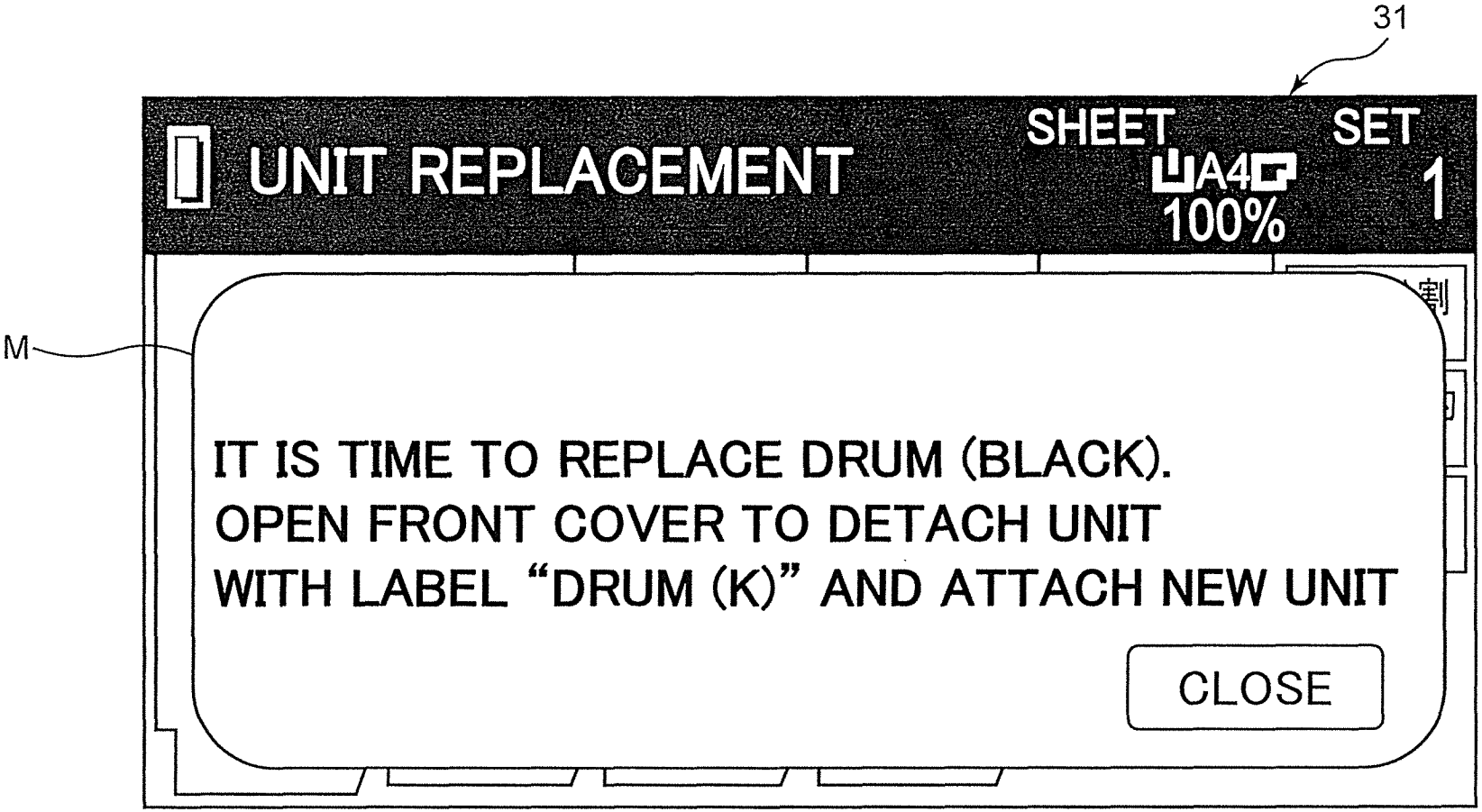
FIG. 4 is a diagram showing a display displaying a message recommending detachment of a replaceable unit.

Hereinafter, there will be described an operation of the copier 1 performed for the detachment of a replaceable unit 8 from the copier 1 by a user. The following description provides details of the history information storage 11, the operation controller 12, the detachment necessity determiner 13, and the power supply controller 14. FIG. 3 is a flowchart showing the operation of the copier 1 performed for the detachment of a replaceable unit 8 from the copier 1 by a user. FIG. 4 is an diagram showing the display 31 displaying a message recommending detachment of a replaceable unit 8.

For example, in a state that the four unit connectors 80C, 80M, 80Y, and 80K are attached to the body connectors 90C, 90M, 90Y, and 90K, respectively, a user operates the operation section 30 to input an instruction for executing a print job of forming an image on a sheet. In this case, as shown in FIG. 3, the operation controller 12 receives the execution instruction (S1). Subsequently, the operation controller 12 executes a printing process of causing the image forming sections 2C, 2M, 2Y, and 2K to form an image on a sheet and causing the discharge section 170 to discharge the sheet formed with the image, in accordance with the received execution instruction (S2).

The operation controller 12 cumulatively adds an operating time of the photoreceptor drum 3C having been caused to rotate in the printing process at step S2. Subsequently, the operation controller 12 stores in the history information storage 11 information indicating a total operating time obtained by the cumulative addition, as history information. The history information contains information relating to a history of causing rotation of the photoreceptor drum 3C. In similar manners, the operation controller 12 cumulatively adds an operating time of each of the photoreceptor drums 3M, 3Y, and 3K having been caused to rotate. Subsequently, the operation controller 12 stores in the history information storage 11, for each of the photoreceptor drums 3M, 3Y, and 3K, information indicating a total operating time obtained by the cumulative addition, as history information (S3). Each of the history information contains information relating to a history of causing rotation of each of the photoreceptor drums 3M, 3Y, and 3K.

Thereafter, the detachment necessity determiner 13 causes the outputter 87C to output a signal representing reference information stored in the ROM 86C to the signal terminal 84C. Subsequently, the detachment necessity determiner 13 obtains the reference information represented by the signal received from the signal terminal 84C through the signal terminal 94C. In similar manners, the detachment necessity determiner 13 causes the outputters 87M, 87Y, and 87K to output signals representing reference information stored in the ROMs 86M, 86Y, and 86K to the signal terminals 84M, 84Y, and 84K, respectively. Subsequently, the detachment necessity determiner 13 obtains the reference information represented by each of the signals received from the signal terminals 84M, 84Y, and 84K respectively through the signal terminals 94M, 94Y, and 94K (S4).

Thereafter, the detachment necessity determiner 13 determines whether the total operating time of each of the photoreceptor drums 3C, 3M, 3Y, and 3K indicated by the corresponding history information stored in the history information storage 11 at step S3 is equal to or greater than the corresponding maximum expected operating time indicated by the reference information obtained at step S4 (S5).

In the case where the detachment necessity determiner 13 determines at step S5 that none of the photoreceptor drums 3C, 3M, 3Y, and 3K has a total operating time equal to or greater than the corresponding maximum expected operating time (S6; NO), no photoreceptor drum 3 is considered as terminating the life, in other words, no replaceable unit 8 is considered necessary to be replaced. Accordingly, in this case, the detachment necessity determiner 13 returns the process to step S1 for again causing the image forming sections 2C, 2M, 2Y, and 2K to perform an operation.

On the other hand, in the case where the detachment necessity determiner 13 determines at step S5 that any one of the photoreceptor drums 3C, 3M, 3Y, and 3K has a total operating time equal to or greater than the corresponding maximum expected operating time (S6; YES), the detachment necessity determiner 13 identifies the photoreceptor drum 3 having the total operating time equal to or greater than the corresponding maximum expected operating time. The identified photoreceptor drum 3 is considered as terminating the life. Accordingly, in this case, the detachment necessity determiner 13 determines that a particular replaceable unit 8 including the identified photoreceptor drum 3 needs to be detached for replacing the identified photoreceptor drum 3 (S7).

After the detachment necessity determiner 13 determines that the particular replaceable unit 8 needs to be detached at step S7, the power supply controller 14 turns the power supply switch 21 to the off-state mode (S8). This causes supply of power source voltage from the power source 20 to the power terminal 91 to be turned off. Consequently, the power terminal 81 stops receiving the power source voltage.

Thereafter, the power supply controller 14 causes the display 31 to display a message (notification) recommending detachment of the particular replaceable unit 8 determined to need to be detached by the detachment necessity determiner 13 (S9).

For example, at step S7, the detachment necessity determiner 13 determines that the replaceable unit 8K including the photoreceptor drum 3K needs to be detached. In this case, at step S9, the power supply controller 14 causes the display 31 to display a message M recommending detachment of the replaceable unit 8K (the unit with a label "drum (K)") including the photoreceptor drum 3K, as shown in FIG. 4, for example.

In addition, at step S9, the power supply controller 14 may alternatively cause the speaker 33 to output a sound representing the message M, instated of or in addition to causing the display 31 to display the message M recommending detachment of the particular replaceable unit 8 determined to need to be detached.

In this manner, according to the first embodiment, when the detachment necessity determiner 13 determines that a replaceable unit 8 needs to be detached, supply of power source voltage from the power source 20 to the power terminal 91 is turned off and consequently, the power terminal 81 stops receiving the power source voltage. In addition, when the detachment necessity determiner 13 determines that the particular replaceable unit 8 needs to be detached, the display 31 displays the information M recommending detachment of the particular replaceable unit 8.

This allows a user to recognize the necessity of detaching the particular replaceable unit 8 to detach the same. The particular replaceable unit 8 is not receiving a power source voltage when detached by the user. Therefore, when the unit connector 80 is detached from the body connector 90 for detachment of the particular replaceable unit 8, a surge voltage is less likely to occur in the power terminal 81. Consequently, the particular replaceable unit 8 is less likely to be damaged.

In this manner, according to the first embodiment, there is no need to provide a special member such as spiral spring and abutting pin in each of the unit connectors 80C, 80M, 80Y, and 80K and each of the body connectors 90C, 90M, 90Y, and 90K. Therefore, it is possible to reduce a risk of damaging a particular replaceable unit 8 when it is detached, at a low cost.

Further, according to the first embodiment, the detachment necessity determiner 13 can determine whether a replaceable unit 8 needs to be replaced on the basis of whether the total operating time indicated by the history information stored in the history information storage 11 is equal to or greater than the maximum expected operating time indicated by the reference information stored in the ROM 86. Therefore, when the detachment necessity determiner 13 determines that any one of the photoreceptor drums 3C, 3M, 3Y, and 3K needs to be replaced, it is determined that a particular replaceable unit 8 including the identified photoreceptor drum 3 needs to be replaced. This allows the detachment necessity determiner 13 to determine the necessity of detachment of the particular replaceable unit 8 properly.

Figure 5:
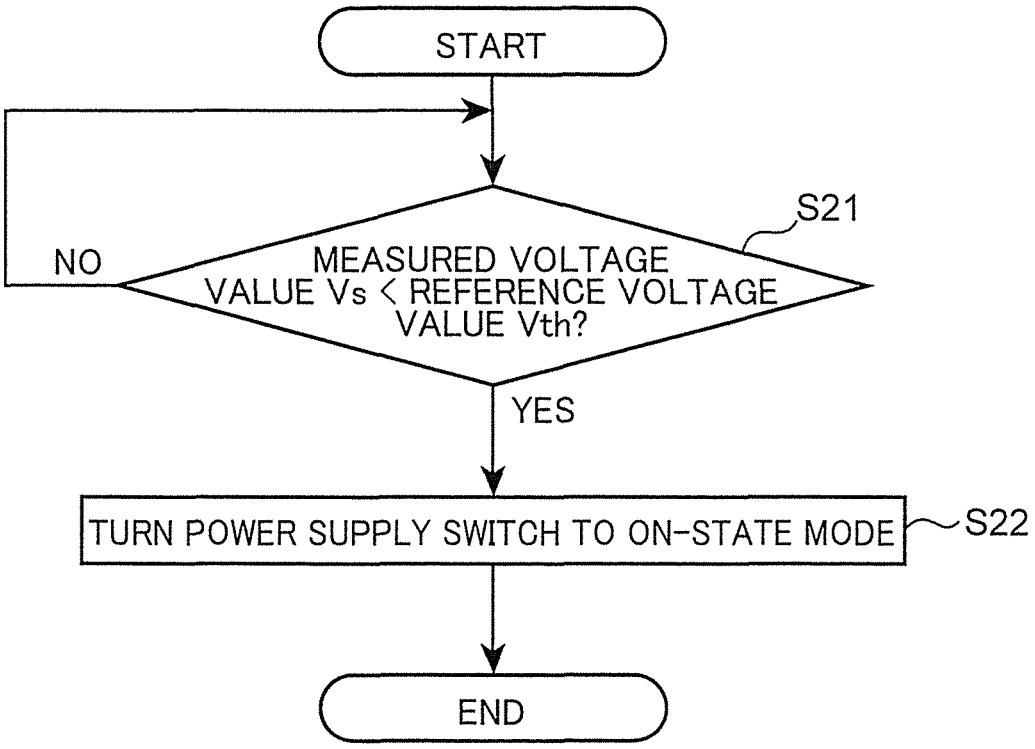
FIG. 5 is a flowchart showing an operation of the copier performed when a user attaches a replaceable unit to the copier.

Now there will be described an operation of the copier 1 performed for the attachment of a replaceable unit 8 including a photoreceptor drum 3 to the copier 1 by a user. The following description provides details of the electrical connection detector 15. FIG. 5 is a flowchart showing the operation of the copier 1 performed when a user attaches the replaceable unit 8 to the copier 1.

As shown in FIG. 5, the electrical connection detector 15 measures a voltage value Vs of a voltage impressed from the power source 20 (FIG. 2) through the resistor 22 (FIG. 2). Subsequently, the electrical connection detector 15 determines whether the measured voltage value Vs is less than a predetermined reference voltage value Vth, on the basis of which the electrical connection detector 15 detects whether the first connection terminal 92C (FIG. 2) and the second connection terminal 93K (FIG. 2) are electrically connected (S21).

For example, when the unit connectors 80C, 80M, 80Y, and 80K are attached to the body connectors 90C, 90M, 90Y, and 90K, respectively, the power source 20 is electrically connected to the ground through the resistor 22, the first connection terminal 92C, the replaceable units 8C, 8M, 8Y, and 8K, and the second connection terminal 93K. In this case, the first connection terminal 92C is connected to the ground and has a voltage value at ground level. Therefore, the voltage value Vs measured by the electrical connection detector 15 is less than the predetermined reference voltage value Vth. This allows the electrical connection detector 15 to detect that the first connection terminal 92C and the second connection terminal 93K are electrically connected.

On the other hand, when any one of the unit connectors 80C, 80M, 80Y, and 80K is not attached to the corresponding one of the body connectors 90C, 90M, 90Y, and 90K, the electrical connection from the power source 20 to the ground through the resistor 22, the first connection terminal 92C, the replaceable units 8C, 8M, 8Y, and 8K, and the second connection terminal 93K is likely to be broken at a certain location. In this case, an electric current is not flowing from the power source 20 to the first connection terminal 92C through the resistor 22. Therefore, the voltage value Vs measured by the electrical connection detector 15 is not less than the predetermined reference voltage value Vth. This allows the electrical connection detector 15 to detect that the first connection terminal 92C and the second connection terminal 93K are not electrically connected.

In the case where it is detected at step S21 that the first connection terminal 92C and the second connection terminal 93K are electrically connected (S21; YES), the power source 20 is considered to be electrically connected to the ground through the resistor 22, the first connection terminal 92C, the replaceable units 8C, 8M, 8Y, and 8K, and the second connection terminal 93K. In other words, the four unit connectors 80C, 80M, 80Y, and 80K are considered to be attached to the body connectors 90C, 90M, 90Y, and 90K, respectively. Accordingly, the power supply controller 14 turns the power supply switch 21 to the on-state mode (S22), so that a power source voltage starts to be supplied from the power source 20 to the power terminals 91C, 91M, 91Y, and 91K to allow the power terminals 81C, 81M, 81Y, and 81K to receive the power source voltage. Consequently, the photoreceptor drums 3C, 3M, 3Y, and 3K included in the respective replaceable units 8C, 8M, 8Y, and 8K become rotatable.

On the other hand, while the electrical connection detector 15 does not detect an electrical connection between the first connection terminal 92C and the second connection terminal 93K at step S21 (S21; NO), the electrical connection from the power source 20 to the ground through the resistor 22, the first connection terminal 92C, the replaceable units 8C, 8M, 8Y, and 8K, and the second connection terminal 93K is considered to be broken at a particular place. In other words, any one of the four unit connectors 80C, 80M, 80Y, and 80K is considered to be not attached to the body connector 90. Accordingly, the electrical connection detector 15 returns the process to step S21 for detecting attachment of all of the four unit connectors 80C, 80M, 80Y, and 80K on the corresponding body connectors 90C, 90M, 90Y and 90K.

In this manner, according to the first embodiment, the electrical connection detector 15 can detect whether the first connection terminal 92C of the body connector 90C and the second connection terminal 93K of the body connector 90K are electrically connected. Specifically, the electrical connection detector 15 detects whether there is an electrical connection between all of the first connection terminals 82C, 82M, 82Y, and 82K and the second connection terminals 83C, 83M, 83Y, and 83K included in the four unit connectors 80C, 80M, 80Y, and 80K and all of the first connection terminals 92C, 92M, 92Y, and 92K and the second connection terminals 93C, 93M, 93Y, and 93K included in the body connectors 90C, 90M, 90Y, and 90K. This allows proper detection of whether all of the four unit connectors 80C, 80M, 80Y, and 80K are attached to the body connectors 90C, 90M, 90Y, and 90K, respectively.

When it is detected that the first connection terminal 92C of the body connector 90C and the second connection terminal 93K of the body connector 90K are electrically connected, in other words, after all of the four unit connectors 80C, 80M, 80Y, and 80K are attached to the body connectors 90C, 90M, 90Y, and 90K, respectively, a power source voltage starts to be supplied from the power source 20 to the power terminals 91C, 91M, 91Y, and 91K. That means a power source voltage is not supplied to the body connectors 90C, 90M, 90Y, and 90K unless all of the replaceable units 8C, 8M, 8Y, and 8K are attached to the corresponding body connectors 90C, 90M, 90Y, and 90K, respectively. Therefore, each of the replaceable units 8C, 8M, 8Y, and 8K is never attached to the corresponding one of the body connectors 90C, 90M, 90Y, and 90K being supplied with a power source voltage. Consequently, a surge voltage is less likely to occur in a power terminal 81 of a replaceable unit 8 attached to a corresponding body connector 90, so that the attached replaceable unit 8 is less likely to be damaged.

Second Embodiment

In the first embodiment, the replaceable unit 8 including the photoreceptor drum 3 exemplifies a replaceable unit. Similarly to this, the replaceable unit may alternatively be configured as a replaceable unit including a toner supplier 60 which is detachably attached to a copier 1.

Hereinafter, a configuration for attaching the replaceable unit including the toner supplier 60 to the copier 1 will be described in detail. FIG. 6 is a block diagram showing a configuration of a portion related to replaceable units 800C (first replaceable unit), 800M (third replaceable unit), 800Y (third replaceable unit), and 800K (second replaceable unit) including toner suppliers 60C, 60M, 60Y, and 60K, respectively in the copier 1. In FIG. 6, sections and components that are identical to those shown in FIG. 2 are denoted by the same reference numerals as the corresponding blocks shown in FIG. 2, and repeated description thereof will be omitted.

As shown in FIG. 6, the replaceable unit 800C differs from the replaceable unit 8C shown in FIG. 2 in including an internal block 850C in place of the internal block 85C. The internal block 850C includes the toner supplier 60C (operation portion), a ROM 860C (reference information storage), an outputter 870C, and a residual amount detector 880C.

Similarly, the replaceable unit 800M differs from the replaceable unit 8M shown in FIG. 2 in including an internal block 850M in place of the internal block 85M. The internal block 850M includes the toner supplier 60M, a ROM 860M, an outputter 870M, and a residual amount detector 880M. The replaceable unit 800Y differs from the replaceable unit 8Y shown in FIG. 2 in including an internal block 850Y in place of the internal block 85Y. The internal block 850Y includes the toner supplier 60Y, a ROM 860Y, an outputter 870Y, and a residual amount detector 880Y. The replaceable unit 800K differs from the replaceable unit 8K shown in FIG. 2 in including an internal block 850K in place of the internal block 85K. The internal block 850K includes the toner supplier 60K, a ROM 860K, an outputter 870K, and a residual amount detector 880K. The internal blocks 850C, 850M, 850Y, and 850K have a similar configuration to one another, except that they supply toner of a different color.

Hereinafter, the replaceable units 800C, 800M, 800Y, and 800K will be generalizedly referred to as replaceable units 800 in the description of their common feature. The internal blocks 850C, 850M, 850Y, and 850K will be referred to as internal blocks 850 in the description of their common feature.

The ROMs 860C, 860M, 860Y, and 860K will be generalizedly referred to as ROMs 860 in the description of their common feature. The outputters 870C, 870M, 870Y, and 870K will be generalizedly referred to as outputters 870 in the description of their common feature. The residual amount detectors 880C, 880M, 880Y, and 880K will be generalizedly referred to as residual amount detectors 880 in the description of their common feature.

The toner supplier 60 includes a screw feeder to be operated by a power source voltage. This allows the toner supplier 60 to supply toner of the color to the developer 6 (FIG. 1).

The ROM 860 stores reference information serving as a reference for determining whether the relevant toner supplier 60 needs to be replaced. The reference information includes, for example, information indicating a minimum residual toner amount required for a printing process which is predetermined by the specifications of the relevant toner supplier 60.

The outputter 870 reads the reference information stored in the relevant ROM 860, and outputs a signal representing the reference information to the signal terminal 84.

The residual amount detector 880 detects a residual amount of toner contained in the relevant toner supplier 60, and outputs a signal representing the detected residual toner amount to the signal terminal 84.

Figure 7:
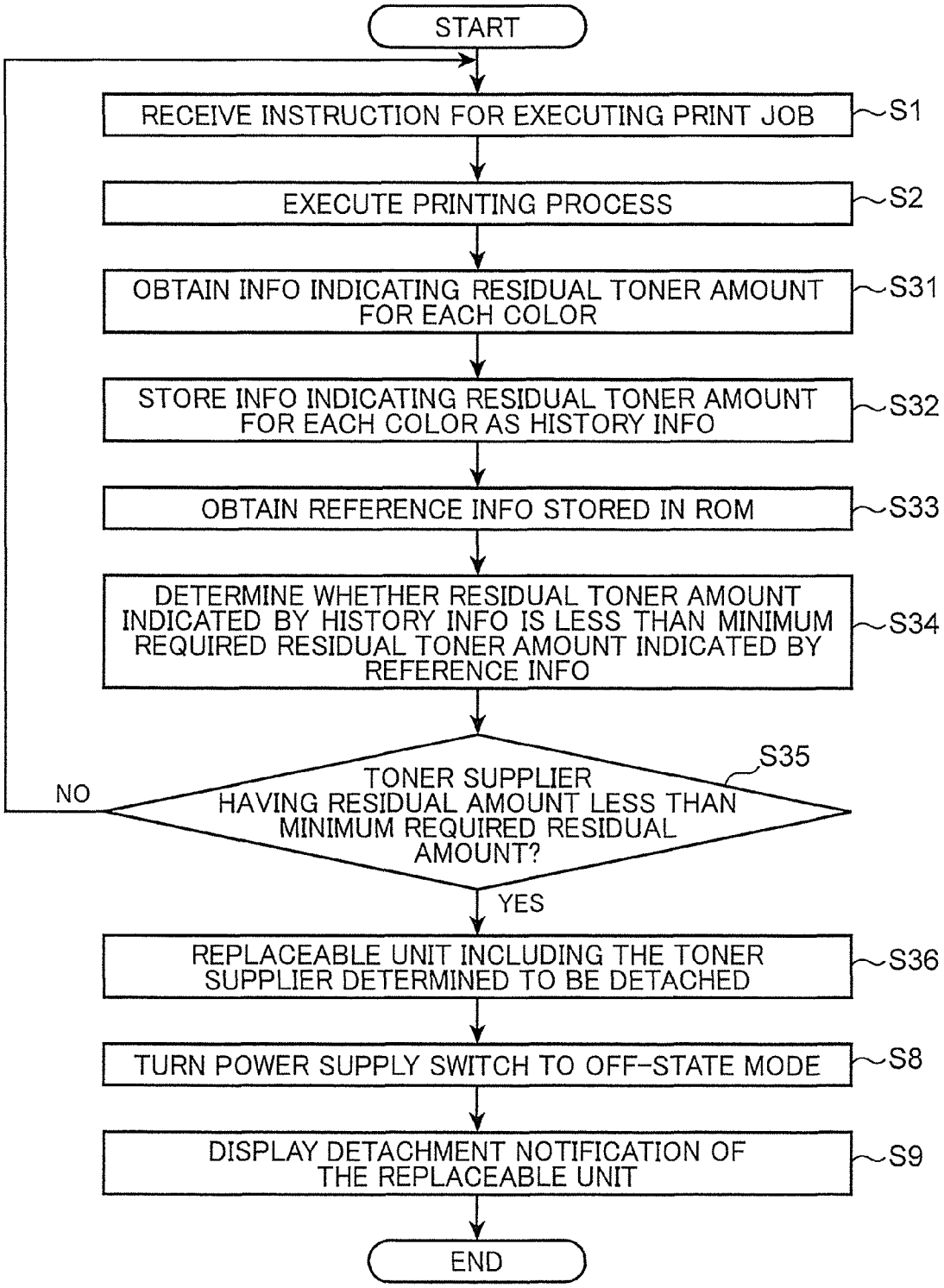
FIG. 7 is a flowchart showing an operation of the copier performed for the detachment of one of the replaceable units including the toner supplier from the copier by a user.

Hereinafter, there will be described an operation of the copier 1 performed for the detachment of a replaceable unit 800 including the toner supplier 60 from the copier 1 by a user. FIG. 7 is a flowchart showing the operation of the copier 1 performed for the detachment of a replaceable unit 800 including the toner supplier 60 from the copier 1 by a user. In FIG. 7, steps to perform the same tasks as those in FIG. 3 are denoted by the same reference numerals as used in FIG. 3, and repeated description thereof will be omitted.

As shown in FIG. 7, the operation of the copier 1 of the second embodiment performed for the detachment of a replaceable unit 800 including the toner supplier 60 from the copier 1 by a user differs from the operation of the copier 1 of the first embodiment performed for the detachment of a replaceable unit 8 including the photoreceptor drum 3 from the copier 1 by a user shown in FIG. 3, in the following respect. The operation of the copier 1 of the second embodiment includes steps S31 to S36 of determining whether a replaceable unit 800 including the toner supplier 60 needs to be replaced, in place of steps S3 to S7 of determining whether a replaceable unit 8 needs to be replaced.

An operation controller 12, after the execution of a printing process at step S2, causes the residual amount detector 880C to output a signal representing a residual amount of cyan toner contained in the tonner supplier 60C to a signal terminal 84C. Subsequently, the operation controller 12 obtains information indicating the residual amount of cyan toner represented by the signal received from the signal terminal 84C through a signal terminal 94C. In similar manners, the operation controller 12 causes the residual amount detectors 880M, 880Y, and 880K to output signals representing respective residual amounts of magenta toner, yellow toner, and black toner contained in the toner suppliers 60M, 60Y, and 60K to signal terminals 84M, 84Y, and 84K, respectively. Subsequently, the operation controller 12 obtains information indicating the respective residual amounts of magenta toner, yellow toner and black toner represented by the signals received from the signal terminals 84M, 84Y, and 84K through signal terminals 94M, 94Y, and 94K, respectively (S31).

Thereafter, the operation controller 12 stores in a history information storage 11 information indicating the residual toner amounts for the respective colors obtained at step S31, as history information (S32). When the toner suppliers 60C, 60M, 60Y, and 60K are caused to supply toner of the respective colors to developers 6C, 6M, 6Y, and 6K, respectively, the residual toner amounts for the respective colors contained in the toner suppliers 60C, 60M, 60Y, and 60K decrease. Accordingly, the residual toner amounts for the respective colors contained in the toner suppliers 60C, 60M, 60Y, and 60K are stored as history information relating to histories of causing the toner suppliers 60C, 60M, 60Y, and 60K to supply toner of the respective colors to the developers 6C, 6M, 6Y, and 6K, respectively.

Thereafter, a detachment necessity determiner 13 obtains, in the same manner as in step S4 (FIG. 3), reference information stored in each of the ROMs 860C, 860M, 860Y, and 860K (S33). Subsequently, the detachment necessity determiner 13 determines whether the residual amount of color toner contained in each of the toner suppliers 60C, 60M, 60Y, and 60K indicated by the corresponding history information stored in the history information storage 11 is less than the corresponding minimum residual toner amount required for a printing process indicated by the reference information obtained at step S33 (S34).

In the case where the detachment necessity determiner 13 determines at step S34 that none of the toner suppliers 60C, 60M, 60Y, and 60K contains toner with a residual amount less than the corresponding minimum residual toner amount required for a printing process (S35; NO), all of the toner suppliers 60C, 60M, 60Y, and 60K are considered as capable of supplying a minimum amount of toner required for a printing process to the developers 6C, 6M, 6Y, and 6K, respectively, in other words, no replaceable unit 800 is considered necessary to be replaced. Accordingly, in this case, the detachment necessity determiner 13 returns the process to step S1 for again causing image forming sections 2C, 2M, 2Y, and 2K to perform an operation.

On the other hand, in the case where the detachment necessity determiner 13 determines at step S34 that any one of the toner suppliers 60C, 60M, 60Y, and 60K contains toner with a residual amount less than the corresponding minimum residual toner amount required for a printing process (S35; YES), the detachment necessity determiner 13 identifies the toner supplier 60 containing the toner with the residual amount less than the corresponding minimum residual toner amount required for a printing process. The identified toner supplier 60 is considered as incapable of supplying a minimum amount of toner required for a printing process to the corresponding developer 6. Accordingly, in this case, the detachment necessity determiner 13 determines that a particular replaceable unit 800 including the identified toner supplier 60 needs to be detached for replacing the identified toner supplier 60 (S36).

An operation of the copier 1 of the second embodiment performed for the attachment of a replaceable unit 800 including the tonner supplier 60 to the copier 1 by a user is the same as the operation of the copier 1 of the first embodiment performed for the attachment of a replaceable unit 8 including the photoreceptor drum 3 to the copier 1 by a user shown in FIG. 5. Accordingly, the description thereof is omitted.

Third Embodiment

In similarly to the replaceable units of the first embodiment and the second embodiment, a replaceable unit including a developer 6 may be configured to be detachably attachable to a copier 1.

Figure 8:
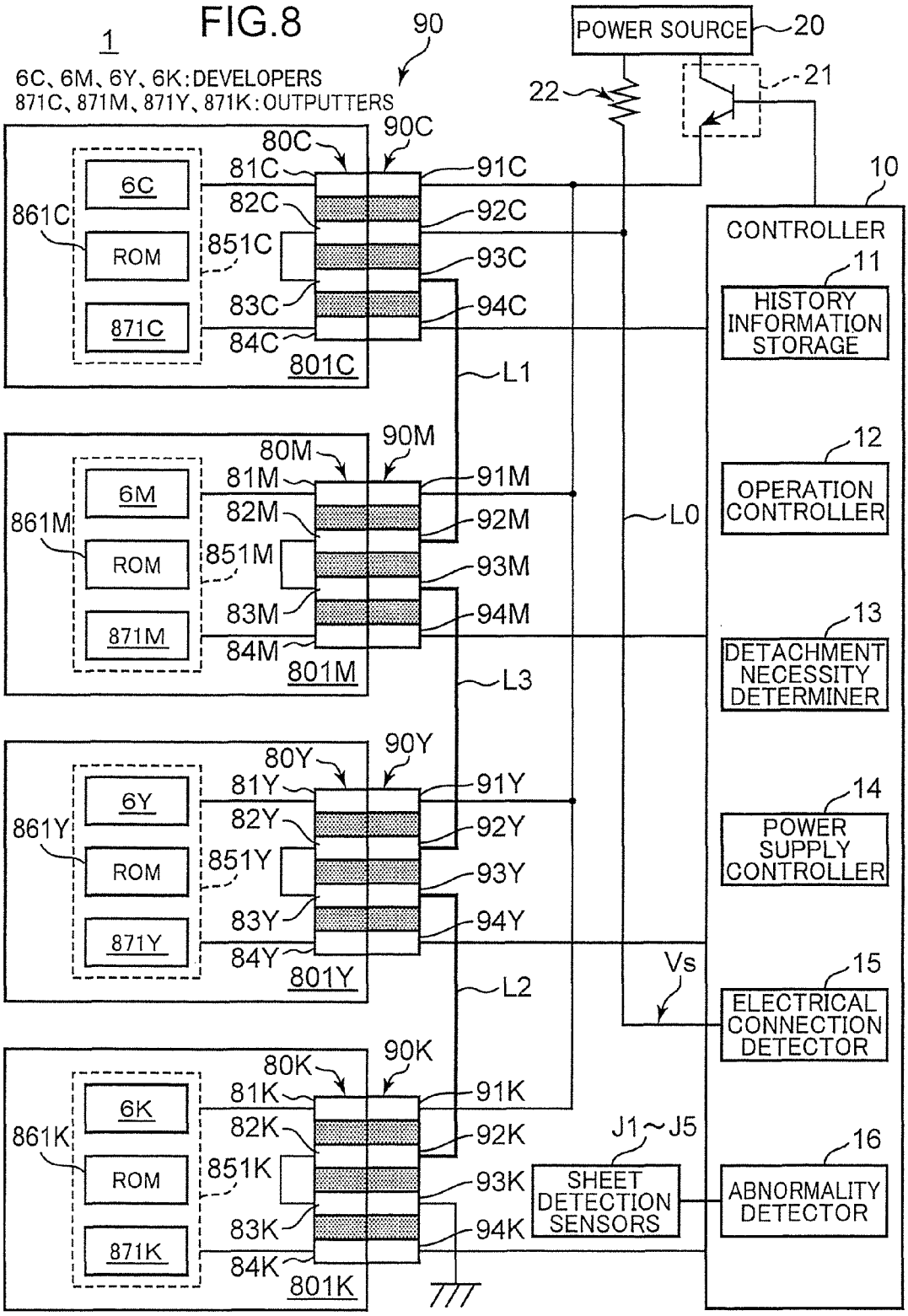
FIG. 8 is a block diagram showing a configuration of a portion related to replaceable units including a developer in the copier.

Hereinafter, a configuration for attaching the replaceable unit including the developer 6 to the copier 1 will be described in detail. FIG. 8 is a block diagram showing a configuration of a portion related to replaceable units 801C (first replaceable unit), 801M (third replaceable unit), 801Y (third replaceable unit), and 801K (second replaceable unit) including developers 6C, 6M, 6Y, and 6K, respectively in the copier 1. In FIG. 8, sections and components that are identical to those shown in FIG. 2 are denoted by the same reference numerals of the corresponding blocks in FIG. 2, and repeated description thereof will be omitted.

As shown in FIG. 8, the replaceable unit 801C differs from the replaceable unit 8C shown in FIG. 2 in the aspect of including an internal block 851C in place of the internal block 85C (FIG. 2). The internal block 851C includes the developer 6C (operation portion), a ROM 861C (reference information storage), and an outputter 871C.

Similarly, the replaceable unit 801M differs from the replaceable unit 8M shown in FIG. 2 in the aspect of including an internal block 851M in place of the internal block 85M (FIG. 2). The internal block 851M includes the developer 6M, a ROM 861M, and an outputter 871M. The replaceable unit 801Y differs from the replaceable unit 8Y shown in FIG. 2 in the aspect of including an internal block 851Y in place of the internal block 85Y (FIG. 2). The internal block 851Y includes the developer 6Y, a ROM 861Y, and an outputter 871Y. The replaceable unit 801K differs from the replaceable unit 8K shown in FIG. 2 in the aspect of including an internal block 851K in place of the internal block 85K (FIG. 2). The internal block 851K includes the developer 6K, a ROM 861K, and an outputter 871K. The internal blocks 851C, 851M, 851Y, and 851K have a similar configuration to one another, except that they use toner of a different color for development.

Hereinafter, the replaceable units 801C, 801M, 801Y, and 801K will be generalizedly referred to as replaceable units 801 in the description of their common feature. The internal blocks 851C, 851M, 851Y, and 851K will be generalizedly referred to as internal blocks 851 in the description of their common feature.

The ROMs 861C, 861M, 861Y, and 861K will be generalizedly referred to as ROMs 861 in the description of their common feature. The outputters 871C, 871M, 871Y, and 871K will be generalizedly referred to as outputters 871 in the description of their common feature.

The developer 6 includes a developing roller to be operated by a power source voltage. This allows the developer 6 to cause toner of the color to be adhered to an electrostatic latent image on the photoreceptor drum 3.

The ROM 861 stores reference information serving as a reference for determining whether the relevant developer 6 needs to be replaced. The reference information includes, for example, information indicating a maximum expected operating time during which the developer 6 is rotated. The maximum expected operating time is predetermined by the specifications of the developing roller included in the developer 6.

The outputter 871 reads the reference information stored in the relevant ROM 861, and outputs a signal representing the reference information to the terminal 84.

Figure 9:
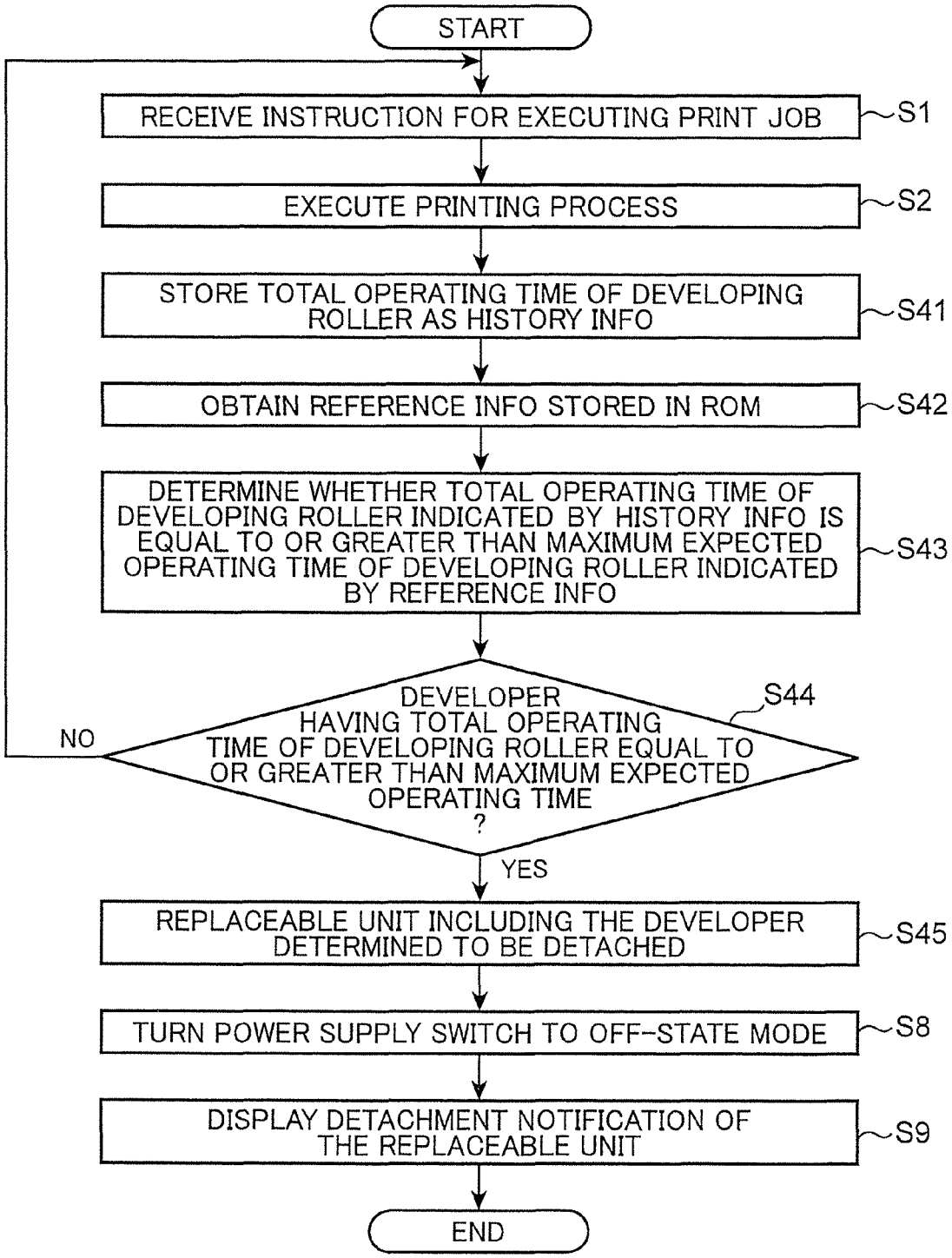
FIG. 9 is a flowchart showing an operation of the copier performed for the detachment of one of the replaceable units including the developer from the copier by a user.

Hereinafter, there will be described an operation of the copier 1 performed for the detachment of a replaceable unit 801 including the developer 6 from the copier 1 by a user. FIG. 9 is a flowchart showing the operation of the copier 1 performed for the detachment of a replaceable unit 801 including the developer 6 from the copier 1 by a user. In FIG. 9, steps to perform the same tasks as those in FIG. 3 are denoted by the same reference numerals as used in FIG. 3, and repeated description thereof will be omitted.

As shown in FIG. 9, the operation of the copier 1 of the third embodiment performed for the detachment of a replaceable unit 801 including the developer 6 from the copier 1 by a user differs from the operation of the copier 1 of the first embodiment performed for the detachment of a replaceable unit 8 including the photoreceptor drum 3 from the copier 1 by a user shown in FIG. 3, in the following respect. The operation of the copier 1 of the third embodiment includes steps S41 to S45 of determining whether a replaceable unit 801 including the developer 6 needs to be replaced, in place of steps S3 to S7 of determining whether a replaceable unit 8 needs to be replaced.

An operation controller 12 cumulatively adds an operating time of the developing roller included in the developer 6C having been caused to rotate in a printing process at step S2. Subsequently, the operation controller 12 stores in a history information storage 11 information indicating a total operating time obtained by the cumulative addition, as history information. The history information contains information relating to a history of causing rotation of the developer 6C. In similar manners, the operation controller 12 cumulatively adds an operating time of the developing roller included in each of the developers 6M, 6Y, and 6K having been caused to rotate. Subsequently, the operation controller 12 stores in the history information storage 11, for each of the developers 6M, 6Y, and 6K, information indicating a total operating time obtained by the cumulative addition, as history information (S41). Each of the history information contains information relating to a history of causing rotation of each of the developers 6M, 6Y, and 6K.

Thereafter, a detachment necessity determiner 13 obtains the reference information stored in each of the ROMs 861C, 861M, 861Y, and 861K in the same manner as in step S4 (FIG. 3) (S42). Subsequently, the detachment necessity determiner 13 determines whether the total operating time of the developing roller included in each of the developers 6C, 6M, 6Y and 6K indicated by the corresponding history information stored in the history information storage 11 is equal to or greater than the corresponding maximum expected operating time indicated by the reference information obtained at step S42 (S43).

In the case where the detachment necessity determiner 13 determines at step S43 that none of the developers 6C, 6M, 6Y, and 6K has a total operating time of a developing roller equal to or greater than the corresponding maximum expected operating time of the developing roller (S44; NO), no developer 6 is considered as terminating the life, in other words, no replaceable unit 801 is considered necessary to be replaced. Accordingly, in this case, the detachment necessity determiner 13 returns the process to step S1 for causing image forming sections 2C, 2M, 2Y, and 2K to perform an operation again.

On the other hand, in the case where the detachment necessity determiner 13 determines at step S43 that any one of the developers 6C, 6M, 6Y, and 6K has a total operating time equal to or greater than the corresponding maximum expected operating time of the developing roller (S44; YES), the detachment necessity determiner 13 identifies the developer 6 having the total operating time equal to or greater than the corresponding maximum expected operating time. The identified developer 6 is considered as terminating the life. Accordingly, in this case, the detachment necessity determiner 13 determines that a particular replaceable unit 801 including the identified developer 6 needs to be detached for replacing the identified developer 6 (S45).

An operation of the copier 1 of the third embodiment performed for the attachment of a replaceable unit 801 including the developer 6 to the copier 1 by a user is the same as the operation of the copier 1 of the first embodiment performed for the attachment of a replaceable unit 8 including the photoreceptor drum 3 to the copier 1 by a user shown in FIG. 5. Accordingly, the description thereof is omitted.

Fourth Embodiment

In similarly to the replaceable units of the first to third embodiments, a replaceable unit including a fixing section 160 may be configured to be detachably attachable to a main body 100 by opening an unillustrated cover. The cover is provided on the left side of the main body 100 (FIG. 1).

Figure 10:
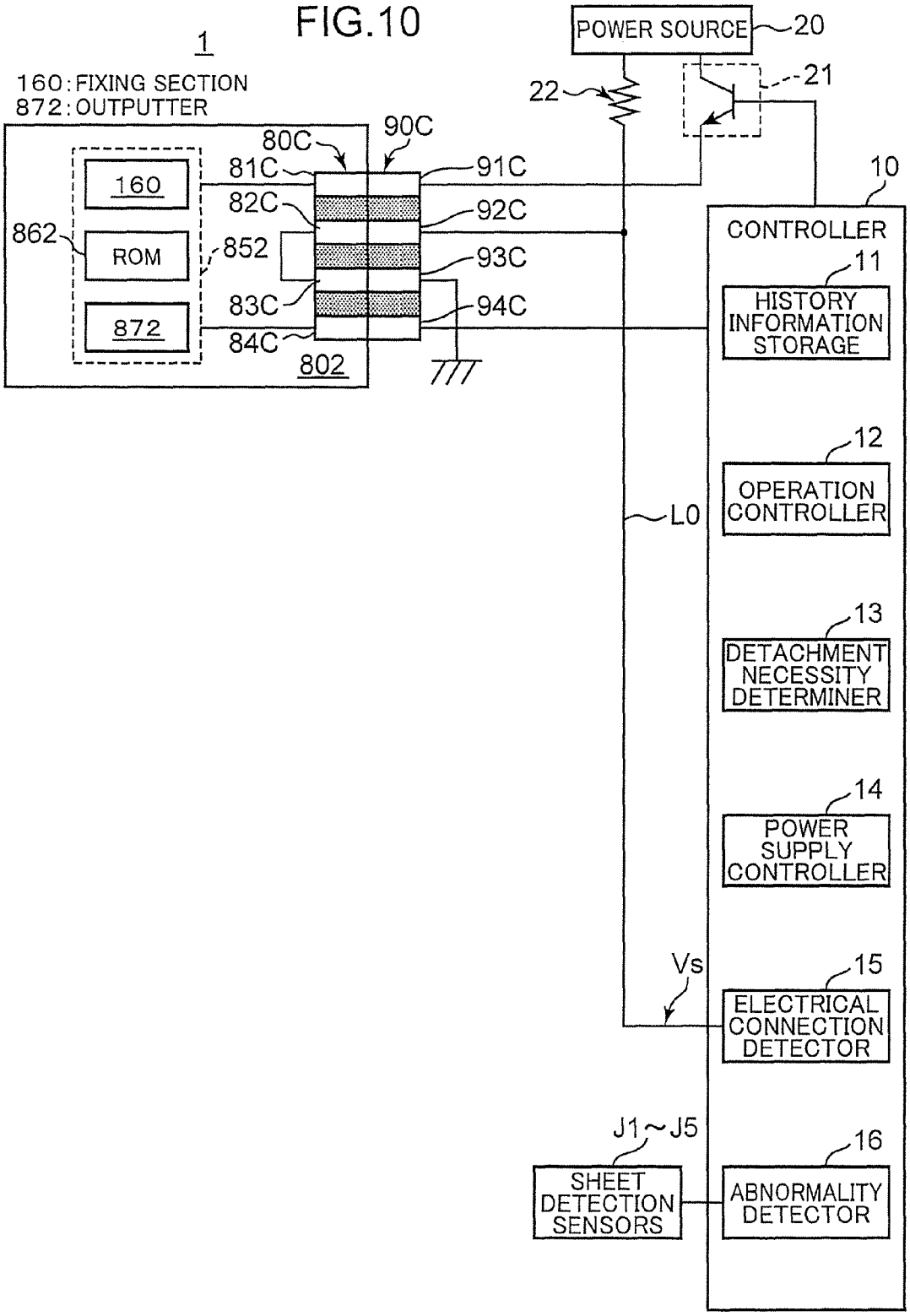
FIG. 10 is a block diagram showing a configuration of a portion related to replaceable units including a fixing section in the copier.

Hereinafter, a configuration for attaching the replaceable unit including the fixing section 160 to the copier 1 will be described in detail. FIG. 10 is a block diagram showing a configuration of a portion related to a replaceable unit 802 (first replaceable unit) including the fixing section 160 in the copier 1. In FIG. 10, sections and components that are identical to those shown in FIG. 2 are denoted by the same reference numerals as the corresponding blocks shown in FIG. 2, and repeated description thereof will be omitted.

As shown in FIG. 10, the replaceable unit 802 differs from the replaceable unit 8C shown in FIG. 2 in the aspect of including an internal block 852 in place of the internal block 85C (FIG. 2). The internal block 852 includes the fixing section 160 (operation portion), a ROM 862 (reference information storage), and an outputter 872.

The fixing section 160 includes a heating roller 161 (FIG. 1) having a heater to be driven by a power source voltage, and a pressing roller 162 (FIG. 1) to be rotated by a power source voltage. This allows the fixing section 160 to fix toner to a sheet.

The ROM 862 stores reference information serving as a reference for determining whether the fixing section 160 needs to be replaced. The reference information includes, for example, information indicating a maximum expected operating time during which the pressing roller 162 is rotated. The maximum expected operating time is predetermined by the specifications of the pressing roller 162.

The outputter 872 reads the reference information stored in the ROM 862, and outputs a signal representing the reference information to a signal terminal 84C.

A second connection terminal 93C of the fourth embodiment differs from the second connection terminal 93C of the first embodiment shown in FIG. 2 in the aspect of having one end to be connected to a unit connector 80C and the other end connected to the ground. Therefore, when the unit connector 80C is attached to a body connector 90C, a power source 20 is electrically connected to the ground through a resistor 22, a first connection terminal 92C, a first connection terminal 82C, a second connection terminal 83C, and the second connection terminal 93C in the order named.

Figure 11:
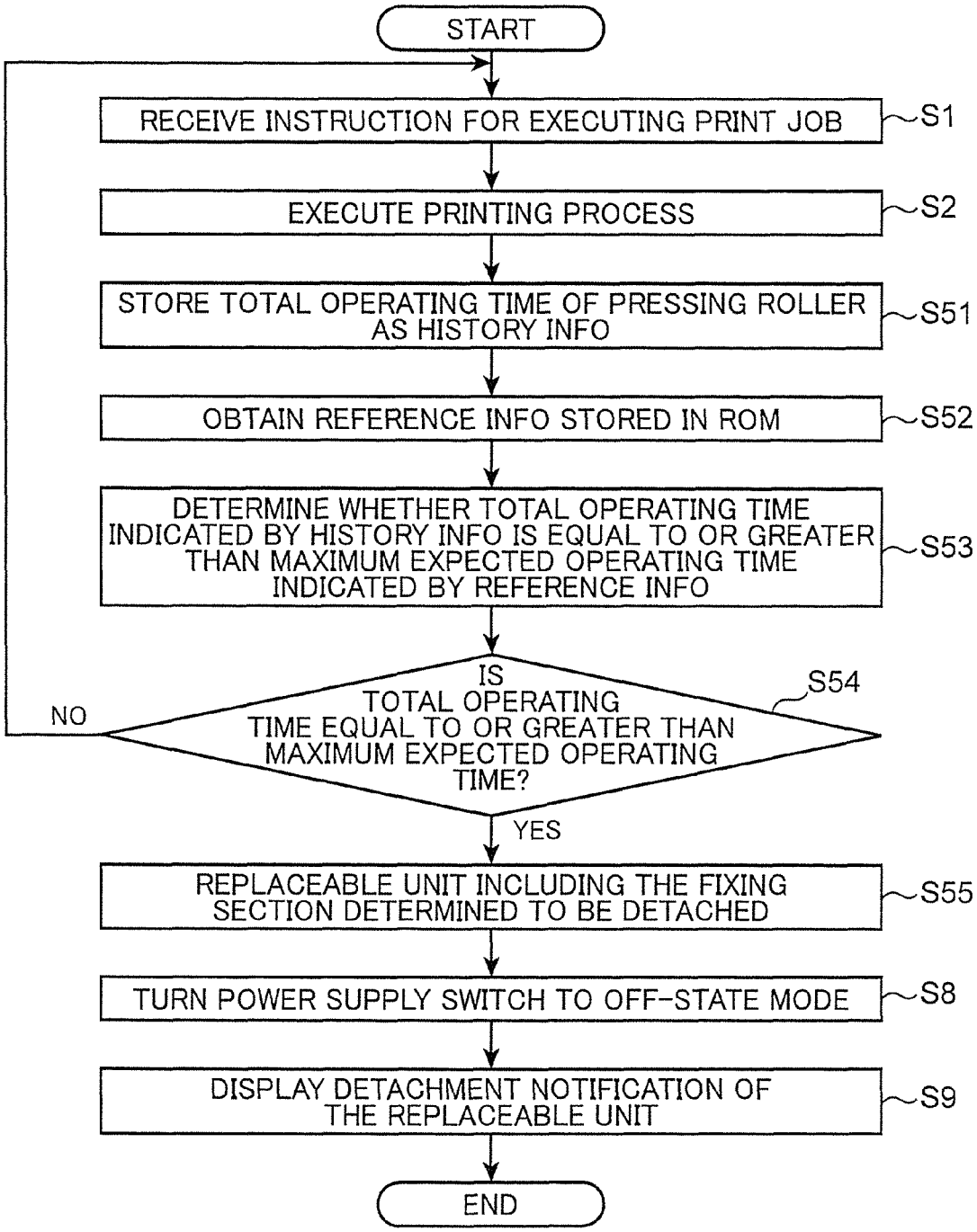
FIG. 11 is a flowchart showing an operation of the copier performed for the detachment of the replaceable unit including the fixing section from the copier by a user.

Hereinafter, there will be described an operation of the copier 1 performed for the detachment of a replaceable unit 802 including the fixing section 160 from the copier 1 by a user. FIG. 11 is a flowchart showing the operation of the copier 1 performed for the detachment of a replaceable unit 802 including the fixing section 160 from the copier 1 by a user. In FIG. 11, steps to perform the same tasks as those in FIG. 3 are denoted by the same reference numerals as used in FIG. 3, and repeated description thereof will be omitted.

As shown in FIG. 11, the operation of the copier 1 of the fourth embodiment performed for the detachment of a replaceable unit 802 including the fixing section 160 from the copier 1 by a user differs from the operation of the copier 1 of the first embodiment performed for the detachment of the replaceable unit 8C (8M, 8Y, 8K) including the photoreceptor drum 3C (3M, 3Y, 3K) from the copier 1 by a user shown in FIG. 3, in the following respect. The operation of the copier 1 of the fourth embodiment includes steps S51 to S55 of determining whether a replaceable unit 802 including the fixing section 160 needs to be replaced, in place of steps S3 to S7 of determining whether a replaceable unit 8C (8M, 8Y, 8K) needs to be replaced.

An operation controller 12 cumulatively adds an operating time of the pressing roller 162 having been caused to rotate in a printing process at step S2. Subsequently, the operation controller 12 stores in a history information storage 11 information indicating a total operating time obtained by the cumulative addition, as history information (S51). The history information contains information relating to a history of causing operation of the fixing section 160.

Thereafter, a detachment necessity determiner 13 obtains the reference information stored in the ROM 862 in the same manner as in step S4 (FIG. 3) (S52). Subsequently, the detachment necessity determiner 13 determines whether the total operating time of the pressing roller 162 indicated by the history information stored in the history information storage 11 is equal to or greater than the maximum expected operating time indicated by the reference information obtained at step S52 (S53).

In the case where the detachment necessity determiner 13 determines at step S53 that the total operating time of the pressing roller 162 is not equal to or greater than the maximum expected operating time (S54; NO), the fixing 160 is considered as not terminating the life, in other words, the replaceable unit 802 is considered unnecessary to be replaced. Accordingly, in this case, the detachment necessity determiner 13 returns the process to step S1 for causing the image forming sections 2 to perform an operation again.

On the other hand, in the case where the detachment necessity determiner 13 determines at step S53 that the total operating time of the pressing roller 162 is equal to or greater than the maximum expected operating time (S54; YES), the fixing section 160 is considered as terminating the life. Accordingly, in this case, the detachment necessity determiner 13 determines that the replaceable unit 802 needs to be detached for replacing the fixing section 160 (S55).

Now, there will be described an operation of the copier 1 performed for the attachment of the replaceable unit 802 including the fixing section 160 to the copier 1 by a user. The operation of the copier 1 of the fourth embodiment performed for the attachment of the replaceable unit 802 including the fixing section 160 to the copier 1 by a user is the same as the operation of the copier 1 of the first embodiment performed for the attachment of the replaceable unit 8 including the photoreceptor drum 3 to the copier 1 by a user shown in FIG. 5. However, an electrical connection detector 15 of the fourth embodiment differs from the electrical connection detector 15 of the first embodiment in detecting, at step S21, whether the first connection terminal 92C and the second connection terminal 93C are electrically connected, on the basis of whether a measured voltage value Vs exceeds a predetermined reference voltage value Vth.

For example, when the unit connector 80C is attached to the body connector 90C, the power source 20 is electrically connected to the ground through the resistor 22, the first connection terminal 92C, the replaceable unit 802, and the second connection terminal 93C. Therefore, the first connection terminal 92C is connected to the ground and has a voltage value at ground level. Consequently, the electrical connection detector 15 measures a voltage value Vs less than the predetermined reference voltage value Vth. This allows the electrical connection detector 15 to detect that the first connection terminal 92C and the second connection terminal 94C are electrically connected.

On the other hand, when the unit connector 80C is not attached to the body connector 90C, the electrical connection from the power source 20 to the ground through the resistor 22, the first connection terminal 92C, the replaceable unit 802, and the second connection terminal 93C is likely to be broken at a certain location. Therefore, an electric current is not flowing from the power source 20 to the first connection terminal 92C through the resistor 22. Consequently, the electrical connection detector 15 measures a voltage value not less than the predetermined reference voltage value Vth. This allows the electrical connection detector 15 to detect that the first connection terminal 92C and the second connection terminal 93C are not electrically connected.

According to the fourth embodiment, attachment of the unit connector 80C on the body connector 90C is properly detected by detecting an electrical connection between the first connection terminal 92C and the second connection terminal 93C. After the unit connector 80C is attached to the body connector 90C, a power source voltage starts to be supplied from the power source 20 to a power terminal 91C. In other words, the power terminal 91C is supplied with a power source voltage only when the replaceable unit 802 is attached to the body connector 90C. Therefore, the replaceable unit 802 is never attached to the body connector 90C being supplied with a power source voltage. Consequently, a surge voltage is less likely to occur in a power terminal 81C of the replaceable unit 802 attached to the body connector 90C, so that the attached replaceable unit 802 is less likely to be damaged.

Fifth Embodiment

The copier 1 of each of the above-described first to third embodiments simultaneously switches on and off supply of a power source voltage to the four replaceable units. The copier 1 of the above-described fourth embodiment switches on and off supply of a power source voltage to the single replaceable unit. However, the present disclosure is not limited to the above configurations, and a copier 1 may simultaneously switch on and off supply of a power source voltage to three replaceable units.

Specifically, the copier 1 may allow to simultaneously switch on and off supply of a power source voltage to three replaceable units 8C (first replaceable unit), 8M (third replaceable unit), and 8Y (second replaceable unit) including photoreceptor drums 3C, 3M, 3Y for cyan, magenta, and yellow, respectively, for example. This configuration can be applied to a copier including image forming sections for forming a three-color image of cyan, magenta, and yellow on a sheet but not including an image forming section for forming an image in black on a sheet.

Figure 12:
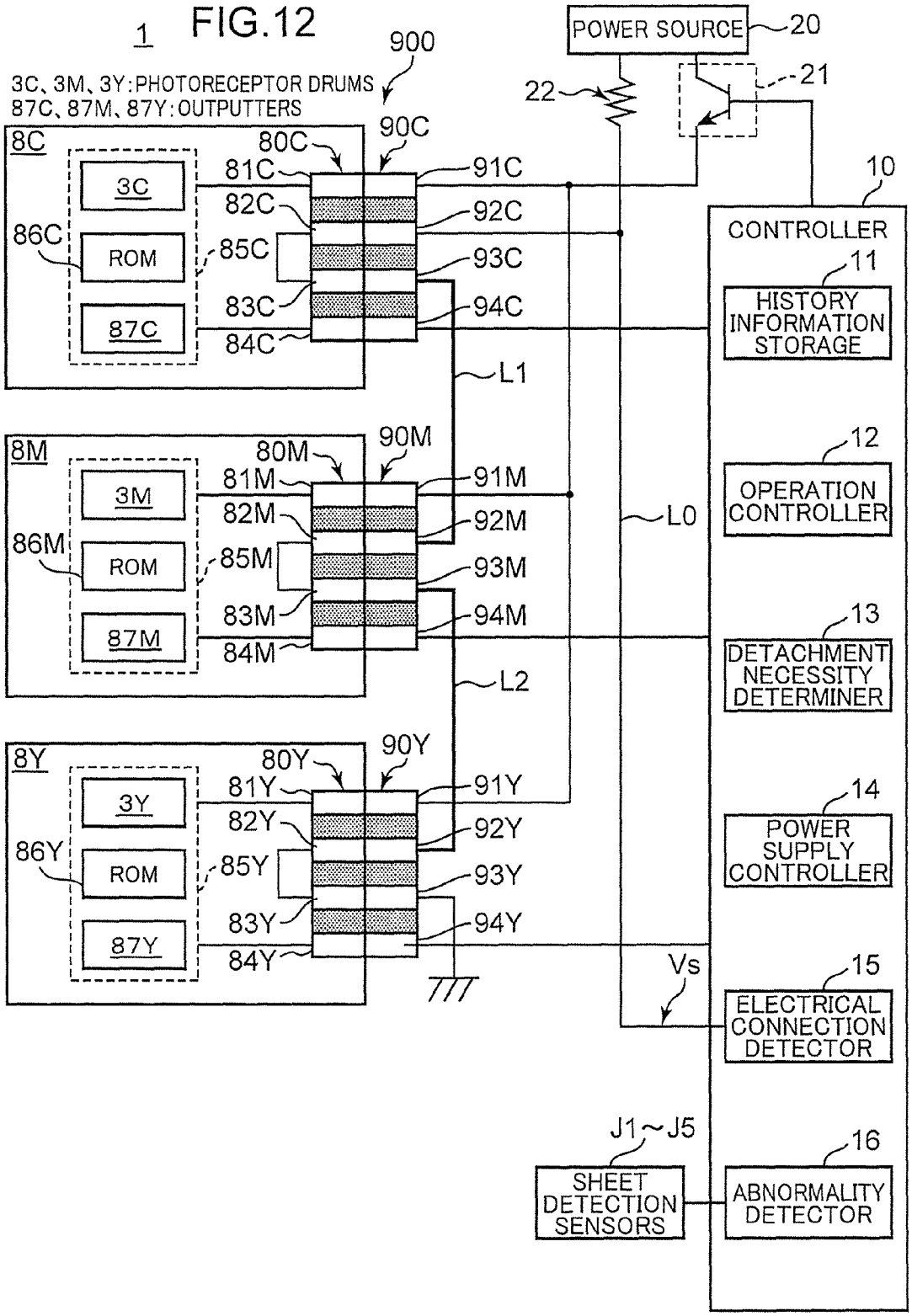
FIG. 12 is a block diagram showing a configuration of a portion related to three replaceable units in the copier.

Hereinafter, the configuration for simultaneously switching on and off the supply of a power source voltage to the three replaceable units 8C, 8M, and 8Y will be described. FIG. 12 is a block diagram showing a configuration of a portion related to the three replaceable units 8C, 8M, and 8Y in the copier 1. In FIG. 12, sections and components that are identical to those shown in FIG. 2 are denoted by the same reference numerals as the corresponding blocks shown in FIG. 2, and repeated description thereof will be omitted.

As shown in FIG. 12, the configuration for simultaneously switching on and off the supply of a power source voltage to the three replaceable units 8C, 8M, and 8Y differs from the configuration shown in FIG. 2 in the following respects. The copier 1 of the fifth embodiment shown in FIG. 12 does not include a replaceable unit 8K and a body connector 90K. In addition, a wire L2 (second wire) connects one end of a second connection terminal 93M opposite to the other end connected to a unit connector 80M to one end of a first connection terminal 92Y opposite to the other end connected to a unit connector 80Y. Further, a second connection terminal 93Y has one end connected to the unit connector 80Y and the other end connected to the ground.

Body connectors 90C (first body connector), 90M (third body connector), and 90Y (second body connector) constitute a body connection section 900. In the fifth embodiment, a wire L1 exemplifies a first wire according to the present disclosure.

When all of the three unit connectors 80C, 80M, and 80Y are attached to the corresponding body connectors 90C, 90M, and 90Y, respectively, there is an electrical connection between a first connection terminal 92C and the second connection terminal 93Y passing through all of the first connection terminals 92C, 92M and 92Y and the second connection terminals 93C, 93M, and 93Y included in the three body connectors 90C, 90M, and 90Y and all of first connection terminals 82C, 82M, and 82Y and second connection terminals 83C, 83M, and 83Y included in the three unit connectors 80C, 80M, and 80Y. Therefore, when any one of the three unit connectors 80C, 80M, and 80Y is not attached to the corresponding one of the body connectors 90C, 90M, and 90Y, the above-described electrical connection is likely to be broken at a certain location.

An operation of the copier 1 of the fifth embodiment performed for the detachment of the replaceable unit 8C (8M, 8Y) from the copier 1 by a user is the same as the operation of the copier 1 of the first embodiment shown in FIG. 3. Accordingly, the description thereof is omitted.

An operation of the copier 1 of the fifth embodiment performed for the attachment of the replaceable unit 8C (8M, 8Y) to the copier 1 by a user is the same as the operation of the copier 1 of the first embodiment shown in FIG. 5. However, an electrical connection detector 15 of the fifth embodiment differs from the electrical connection detector 15 of the first embodiment in the aspect of detecting, at step S21, whether the first connection terminal 92C and the second connection terminal 93Y are electrically connected, on the basis of whether a measured voltage value Vs exceeds a predetermined reference voltage value Vth.

For example, when the unit connectors 80C, 80M, and 80Y are attached to the body connectors 90C, 90M, and 90Y, respectively, a power source 20 is electrically connected to the ground through a resistor 22, the first connection terminal 92C, the replaceable units 8C, 8M, and 8Y and the second connection terminal 93Y. Therefore, the first connection terminal 92C is connected to the ground and has a voltage value at ground level. Consequently, the electrical connection detector 15 measures a voltage value Vs less than the predetermined reference voltage value Vth. This allows the electrical connection detector 15 to detect that the first connection terminal 92C and the second connection terminal 93Y are electrically connected.

On the other hand, when any one of the unit connectors 80C, 80M, and 80Y is not attached to the corresponding one of the body connectors 90C, 90M, and 90Y, the electrical connection from the power source 20 to the ground through the resistor 22, the first connection terminal 92C, the replaceable units 8C, 8M, and 8Y, and the second connection terminal 93Y is likely to be broken at a certain location. Therefore, an electric current is not flowing from the power source 20 to the first connection terminal 92C through the resistor 22. Consequently, the electrical connection detector 15 measures a voltage value not less than the predetermined reference voltage value Vth. This allows the electrical connection detector 15 to detect that the first connection terminal 92C and the second connection terminal 93Y are not electrically connected.

In this manner, according to the fifth embodiment, the electrical connection detector 15 can detect whether the first connection terminal 92C and the second connection terminal 93Y are electrically connected. Specifically, the electrical connection detector 15 detects whether there is an electrical connection between all of the first connection terminals 82C, 82M, and 82Y and the second connection terminals 83C, 83M, and 83Y included in the three unit connectors 80C, 80M, and 80Y and all of the first connection terminals 92C, 92M, and 92Y and the second connection terminals 93C, 93M, and 93Y included in the three body connectors 90C, 90M, and 90Y. This allows proper detection of whether all of the three unit connectors 80C, 80M, and 80Y are attached to the corresponding body connectors 90C, 90M, and 90Y, respectively.

When it is detected that the first connection terminal 92C and the second connection terminal 93Y are electrically connected, in other words, after all of the three unit connectors 80C, 80M, and 80Y are attached to the corresponding body connectors 90C, 90M, and 90Y, respectively, a power source voltage starts to be supplied from the power source 20 to power terminals 91C, 91M, and 91Y. That means a power source voltage is not supplied to the body connectors 90C, 90M, and 90Y unless all of the replaceable units 8C, 8M, and 8Y are attached to the corresponding body connectors 90C, 90M, and 90Y, respectively. Therefore, each of the replaceable units 8C, 8M, and 8Y is never attached to the corresponding one of the body connectors 90C, 90M, 90Y, and 90K being supplied with a power source voltage. Consequently, a surge voltage is less likely to occur in a power terminal of a replaceable unit attached to a corresponding body connector, so that the attached replaceable unit is less likely to be damaged.

Sixth Embodiment

A copier 1 according to the present disclosure may simultaneously switch on and off supply of a power source voltage to two replaceable units.

Specifically, the copier 1 may simultaneously switch on and off supply of a power source voltage to two adjacent replaceable units including a replaceable unit 803K having a developer 6K for black and a replaceable unit 8K having a photoreceptor drum 3K for black, for example. This configuration can be applied to a copier capable of performing monochromatic copying which includes only a single image forming section for forming an image in black on a sheet, for example.

Figure 13:
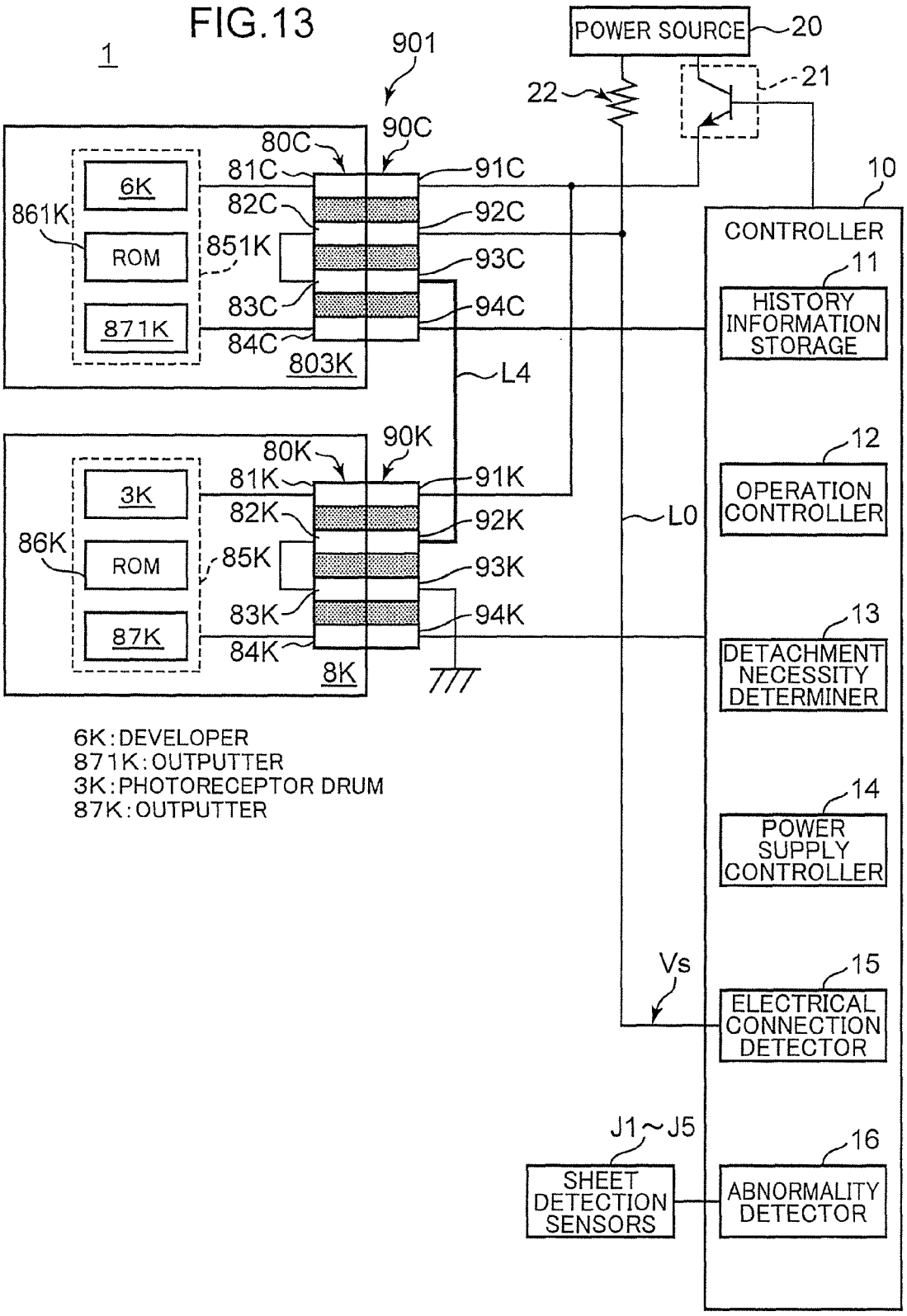
FIG. 13 is a block diagram showing a configuration of a portion related to two replaceable units in the copier.

Hereinafter, there will be described the configuration for simultaneously switching on and off supply of a power source voltage to the two replaceable units including the replaceable unit 803K (first replaceable unit) having the developer 6K for black and the replaceable unit 8K (second replaceable unit) having the photoreceptor drum 3K for black. FIG. 13 is a block diagram showing a configuration of a portion related to the two replaceable units 803K and 8K in the copier 1. In FIG. 13, sections and components that are identical to those shown in FIGS. 2 and 8 are denoted by the same reference numerals as the corresponding blocks in FIG. 2 and FIG. 8, and repeated description thereof will be omitted.

As shown in FIG. 13, the configuration for simultaneously switching on and off the supply of a power source voltage to the two replaceable units 803K and 8K differs from the configuration shown in FIG. 2 in the following respects. The copier 1 shown in FIG. 13 does not include replaceable units 8M and 8Y and body connectors 90M and 90Y. In addition, the copier 1 shown in FIG. 13 includes a wire L4 (wire) connecting one end of a second connection terminal 93C opposite to the other end connected to a unit connector 80C and one end of a first connection terminal 92K opposite to the other end connected to a unit connector 80K. Further, the replaceable unit 803K differs from the replaceable unit 8C shown in FIG. 2 in including an internal block 851K shown in FIG. 8 in place of the internal block 85C (FIG. 2).

Body connectors 90C (first body connector) and 90K (second body connector) constitute a body connection section 901.

When both of the two unit connectors 80C and 80K are attached to the corresponding body connectors 90C and 90K, respectively, there is an electrical connection between a first connection terminal 92C and a second connection terminal 93K passing through all of the first connection terminals 92C, 92K and the second connection terminals 93C, 93K included in the two body connectors 90C and 90K and all of first connection terminals 82C, 82K and second connection terminals 83C, 83K included in the two unit connectors 80C and 80K. Therefore, when either of the two unit connectors 80C and 80K is not attached to the corresponding one of the body connectors 90C and 90K, the above-described electrical connection is likely to be broken at a certain location.

An operation of the copier 1 performed for the detachment of the replaceable unit 803K (8K) from the copier 1 by a user is as follows. The copier 1 determines whether the replaceable unit 8K needs to be replaced, in the same manner as in steps S1 to S7 shown in FIG. 3. Further, the copier 1 determines whether the replaceable unit 803K needs to be replaced, in the same manner as in steps S41 to S45 shown in FIG. 9. Subsequently, the copier 1 performs steps S8 and S9 shown in FIG. 3.

An operation of the copier 1 of the sixth embodiment performed for the attachment of the replaceable unit 803K (8K) to the copier 1 by a user is the same as the operation of the copier 1 of the first embodiment shown in FIG. 5. However, an electrical connection detector 15 of the sixth embodiment differs from the electrical connection detector 15 of the first embodiment in the aspect of detecting, at step S21, whether the first connection terminal 92C and the second connection terminal 93K are electrically connected, on the basis of whether a measured voltage value Vs exceeds a predetermined reference voltage value Vth.

For example, when the unit connectors 80C and 80K are attached to the body connectors 90C and 90K, respectively, a power source 20 is electrically connected to the ground through a resistor 22, the first connection terminal 92C, the replaceable units 803K and 8K, and the second connection terminal 93K. Therefore, the first connection terminal 92C is connected to the ground and has a voltage value at ground level. Consequently, the electrical connection detector 15 measures a voltage value Vs less than the predetermined reference voltage value Vth. This allows the electrical connection detector 15 to detect that the first connection terminal 92C and the second connection terminal 93K are electrically connected.

On the other hand, when either of the unit connectors 80C and 80K is not attached to the corresponding one of the body connectors 90C and 90K, the electrical connection from the power source 20 to the ground through the resistor 22, the first connection terminal 92C, the replaceable units 803K and 8K, and the second connection terminal 93K is likely to be broken at a certain location. Therefore, an electric current is not flowing from the power source 20 to the first connection terminal 92C through the resistor 22. Consequently, the electrical connection detector 15 measures a voltage value not less than the predetermined reference voltage value Vth. This allows the electrical connection detector 15 to detect that the first connection terminal 92C and the second connection terminal 93K are not electrically connected.

In this manner, according to the sixth embodiment, the electrical connection detector 15 can detect whether the first connection terminal 92C and the second connection terminal 93K are electrically connected. Specifically, the electrical connection detector 15 detects whether there is an electrical connection between all of the first connection terminals 82C, 82K and the second connection terminals 83C, 83K included in the two unit connectors 80C and 80K, and all of the first connection terminals 92C, 92K and the second connection terminals 93C, 93K included in the two body connectors 90C and 90K. This allows proper detection of whether both of the two unit connectors 80C and 80K are attached to the corresponding body connectors 90C and 90K, respectively.

When it is detected that the first connection terminal 92C and the second connection terminal 93K are electrically connected, in other words, after both of the two unit connectors 80C and 80K are attached to the corresponding body connectors 90C and 90K, respectively, a power source voltage starts to be supplied from the power source 20 to power terminals 91C and 91K. That means a power source voltage is not supplied to the body connectors 90C and 90K unless both of the replaceable units 803K and 8K are attached to the corresponding body connectors 90C and 90K, respectively. Therefore, each of the replaceable units 803K and 8K is never attached to the corresponding one of the body connectors 90C and 90K being supplied with a power source voltage. Consequently, a surge voltage is less likely to occur in a power terminal of a replaceable unit attached to a corresponding body connector, so that the attached replaceable unit is less likely to be damaged.

Seventh Embodiment

A copier 1 according to the present disclosure may simultaneously switch on and off supply of a power source voltage to five or more replaceable units. Specifically, the copier 1 may simultaneously switch on and off supply of a power source voltage to five replaceable units which include four replaceable units respectively having photoreceptor drums 3C, 3M, 3Y, and 3K and a replaceable unit having a fixing section 160. Alternatively, the copier 1 may simultaneously switch on and off supply of a power source voltage to eight replaceable units which include four replaceable units respectively having photoreceptor drums 3C, 3M, 3Y, and 3K and four replaceable units respectively having developers 6C, 6M, 6Y, and 6K.

Figure 14:
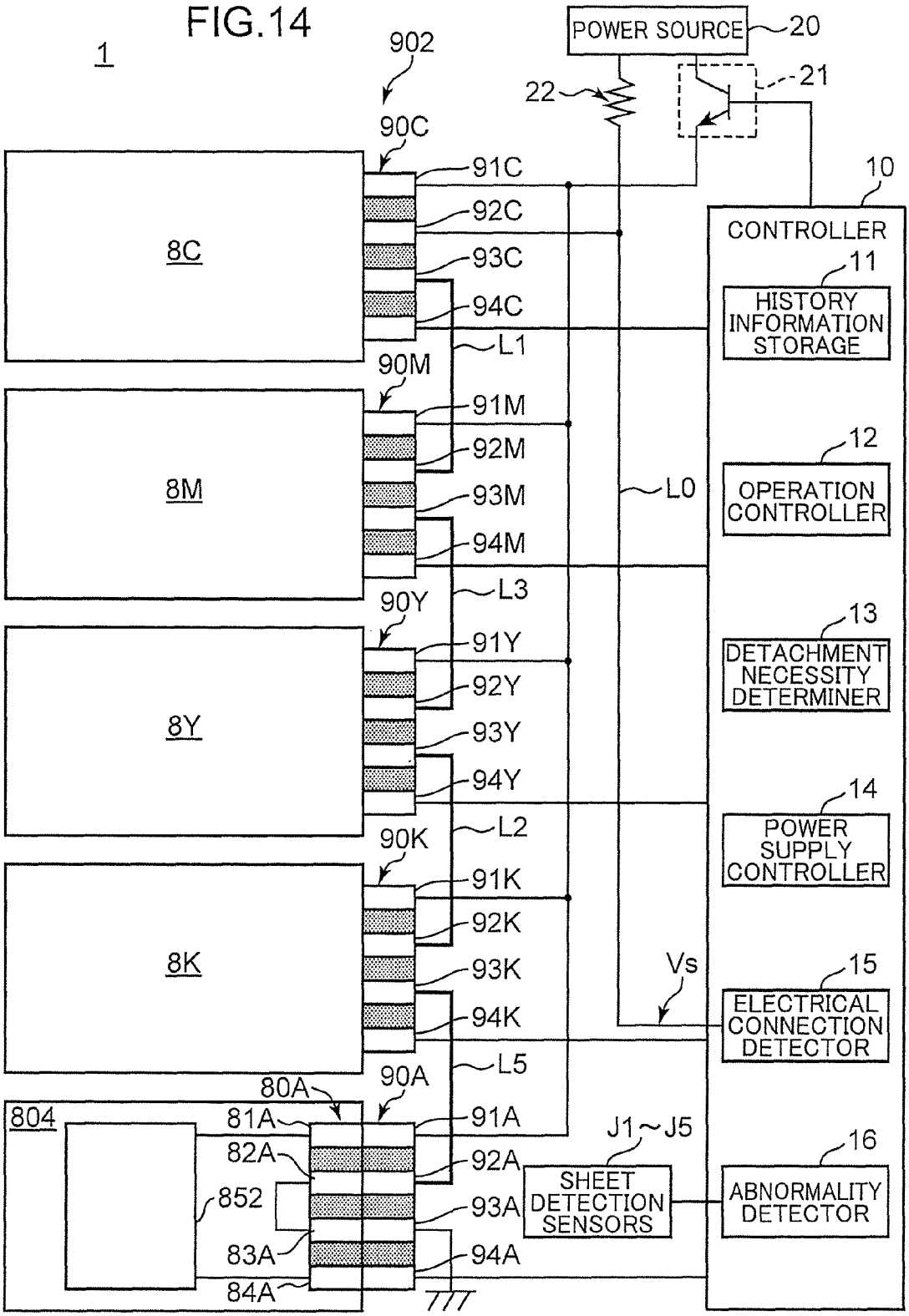
FIG. 14 is a block diagram showing a configuration of a portion related to five replaceable units in the copier.

Hereinafter, as an example of the configuration of the copier 1 capable of simultaneously switching on and off supply of a power source voltage to five or more replaceable units, there will be described a configuration for simultaneously switch on and off supply of a power source voltage to five replaceable units which include four replaceable units 8C (first replaceable unit), 8M (third replaceable unit), 8Y (third replaceable unit), and 8K (third replaceable unit) respectively having photoreceptor drums 3C, 3M, 3Y, and 3K and a replaceable unit 804 (second replaceable unit) having a fixing section 160. FIG. 14 is a block diagram showing the configuration of a portion related to the five replaceable units 8C, 8M, 8Y, 8K, and 804 in the copier 1. In FIG. 14, sections and components that are identical to those shown in FIGS. 2 and 10 are denoted by the same reference numerals as the corresponding blocks in FIG. 2 and FIG. 10, and repeated description thereof will be omitted.

As shown in FIG. 14, the replaceable unit 804 including the fixing section 160 has the same configuration as that of the replaceable unit 802 shown in FIG. 10, and includes an internal block 852 shown in FIG. 10 and a unit connector 80A. The unit connector 80A has the same configuration as that of the unit connector 80C shown in FIG. 2. The unit connector 80A includes a power terminal 81A, a first connection terminal 82A, a second connection terminal 83A, and a signal terminal 84A and detachably connected to a body connector 90A. The body connector 90A has the same configuration as that of the body connector 90C, and includes a power terminal 91A, a first connection terminal 92A, a second connection terminal 93A, and a signal terminal 94A.

The copier 1 includes a wire L5 (second wire) connecting one end of a second connection terminal 93K opposite to the other end connected to the replaceable unit 8K to one end of the first connection terminal 92A opposite to the other end connected to the unit connector 80A.

Body connectors 90C (first body connector), 90M (third body connector), 90Y (third body connector), 90K (third body connector), and 90A (second body connector) constitute a body connection section 902.

When all of the five replaceable units 8C, 8M, 8Y, 8K and 804 are attached to the corresponding body connectors 90C, 90M, 90Y, 90K, and 90A, respectively, there is an electrical connection between a first connection terminal 92C and the second connection terminal 93A passing through the five body connectors 90C, 90M, 90Y, 90K, and 90A and the five replaceable units 8C, 8M, 8Y, 8K, and 804. Therefore, when any one of the five unit connectors 8C, 8M, 8Y, 8K, and 804 is not attached to the corresponding one of the body connectors 90C, 90M, 90Y, 90K, and 90A, the above-described electrical connection is likely to be broken at a certain location.

An operation of the copier 1 performed for the detachment of the replaceable unit 8C (8M, 8Y, 8K, 804) from the copier 1 by a user is as follows. The copier 1 determines whether each of the replaceable units 8C, 8M, 8Y, and 8K needs to be replaced, in the same manner as in steps S1 to S7 shown in FIG. 3. Further, the copier 1 determines whether the replaceable unit 804 needs to be replaced, in the same manner as in steps S51 to S55 shown in FIG. 11. Subsequently, the copier 1 performs steps S8 and S9 shown in FIG. 3.

An operation of the copier 1 of the seventh embodiment performed for the attachment of the replaceable unit 8C (8M, 8Y, 8K, 804) to the copier 1 by a user is the same as the operation of the copier 1 of the first embodiment shown in FIG. 5. However, an electrical connection detector 15 of the seventh embodiment differs from the electrical connection detector 15 of the first embodiment in the aspect of detecting, at step S21, whether the first connection terminal 92C and the second connection terminal 93A are electrically connected, on the basis of whether a measured voltage value Vs exceeds a predetermined reference voltage value Vth.

As shown in the above-described first to third and seventh embodiments, in the configurations for simultaneously switching on and off supply of a power source voltage to the four or more replaceable units, the body connectors to be connected respectively to the four or more replaceable units are classified into a single first body connector (first body connector), a single second body connector (second body connector) and a plurality of third body connectors (plurality of third body connectors).

The first body connector includes a first connection terminal connected to a controller 10 through a wire L0 (FIGS. 2, 6, 8, and 14). The second body connector includes a second connection terminal connected to the ground. The plurality of third body connectors are of a type different from the first body connector and the second body connector.

For example, in FIG. 14, the body connector 90C corresponds to the first body connector, the body connector 90A corresponds to the second body connector, and the body connectors 90M, 90Y, and 90K correspond to the third body connectors. In the following description, the components shown in blocks of FIG. 14 are indicated in parentheses as examples.

In the configuration for simultaneously switching on and off supply of a power source voltage to four or more replaceable units, there is provided a first wire (wire L1) connecting a second connection terminal (second connection terminal 93C) of a first body connector (body connector 90C) to a first connection terminal (first connection terminal 92M) of a particular one of a plurality of third body connectors (body connector 90M).

Further, there is provided a second wire (wire L5) connecting a first connection terminal (first connection terminal 92A) of a second body connector (body connector 90A) to a second connection terminal (second connection terminal 93K) of another particular one of the plurality of third body connections (body connector 90K) that is different from the particular one of the plurality of third body connectors (body connector 90M).

First connection terminals (first connection terminals 92Y, 92K) and second connection terminals (second connection terminals 93M, 93Y) of the plurality of third body connectors excluding the above-mentioned first connection terminal (first connection terminal 92M) of the particular one (body connector 90M) of the plurality of third body connectors and the above-mentioned second connection terminal (second connection terminal 93K) of the another particular one (body connector 90K) of the plurality of third body connectors are connected in the copier 1 in such a manner that a second connection terminal of one of the plurality of third body connectors is connected to a first connection terminal of another one of the plurality of third body connectors (by means of a wire L3 connecting the first connection terminal 92Y to the second connection terminal 93M, and a wire L2 connecting the first connection terminal 92Y to the second connection terminal 93M).

Therefore, when all of the four or more replaceable units are attached to the corresponding body connectors, respectively, there is an electrical connection between the first connection terminal (first connection terminal 93C) of the first body connector and the second connection terminal (second connection terminal 93A) of the second body connector passing through all of the first and second connection terminals included in the four or more body connectors and all of the first and second connection terminals included in the four or more replaceable units. When any one of the four or more replaceable units is not attached to the corresponding body connector, the above-described electrical connection is likely to be broken at a certain location.

An electrical connection detector 15 detects whether the first connection terminal (first connection terminal 93C) of the first body connector and the second connection terminal (second connection terminal 93A) of the second body connector are electrically connected, on the basis of whether a voltage value Vs of a voltage impressed from a power source 20 through a resistor 22 exceeds a predetermined reference voltage value Vth.

(1) A detachment necessity determiner 13 may make the same determination as made at step S55 (FIG. 11) also when an abnormality detector 16 detects an occurrence of sheet jam between a sheet detection sensor J1 and a sheet detection sensor J3 in a sheet conveyance passage. Specifically, the detachment necessity determiner 13 may determine that a replaceable unit 802 including a fixing section 160 needs to be detached, also when the abnormality detector 16 detects the occurrence of sheet jam. This is because the replaceable unit 802 including the fixing section 160 is considered necessary to be detached for eliminating the sheet jam. In this case, a copier 1 may be simplified so as not to execute steps S51 to S55 (FIG. 11) of determining whether the fixing section 160 needs to be replaced on the basis of history information and reference information.

In this case, after the abnormality detector 16 detects the occurrence of sheet jam between the sheet detection sensors J1 and J3, namely, in a conveyance passage 153 (FIG. 1), the replaceable unit 802 including the fixing section 160 is detached for eliminating the sheet jam, for example. At this time, the replaceable unit 802 including the fixing section 160 is less likely to be supplied with a power source, so that the replaceable unit 802 including the fixing section 160 is less likely to be damaged.

(2) An abnormality detector 16 may detect, in addition to an occurrence of sheet jam, an abnormality of an operation portion included in a replaceable unit in accordance with a conventional abnormality detection method. Examples of such an abnormality of an operation portion in a replaceable unit include an abnormality in the rotation of a particular photoreceptor drum 3, an abnormality in the rotation of a particular screw feeder, an abnormality of the rotation of a particular developing roller, and an abnormality in the rotation of a pressing roller 162.

Correspondingly, a detachment necessity determiner 13 may make the same determination as made at step S7 (FIG. 3), step S36 (FIG. 7), and step S45 (FIG. 9) also when the abnormality detector 16 detects an abnormality of an operation portion included in a replaceable unit. Specifically, the detachment necessity determiner 13 may determine that the replaceable unit including the operation portion detected as having the abnormality needs to be detached. This is because the replaceable unit including the operation portion detected as having the abnormality is considered necessary to be detached for eliminating the abnormality.

In this case, a copier 1 may be simplified so as not to execute steps S3 to S7 (FIG. 3) of determining whether each of photoreceptor drums 3 needs to be replaced on the basis of history information and reference information. Similarly, the copier 1 may be simplified so as not to execute steps S31 to S36 (FIG. 7) of determining whether each of toner suppliers 60 needs to be replaced on the basis of history information and reference information. Further, the copier 1 may be simplified so as not to execute steps S41 to S45 (FIG. 9) of determining whether each of developers 6 needs to be replaced on the basis of history information and reference information.

For example, the abnormality detector 16 detects an abnormality that requires detachment of a replaceable unit for its elimination, such as an occurrence of sheet jam between a sheet detection sensor J1 and a sheet detection sensor J3, and an abnormality in the rotation of a particular photoreceptor drum 3. In this case, the relevant replaceable unit needs to be detached for eliminating the detected abnormality. Therefore, the detachment necessity determiner 13 according to the above-described modified embodiments (1) (2) can properly determine the necessity of detachment of a replaceable unit.

Configurations and the like of the above embodiments shown in FIGS. 1 to 14 merely exemplify an embodiment according to the present disclosure, and are not intended to limit the present disclosure to the above embodiments.

For example, each of the unit connectors 80 (FIG. 2) may be configured so as not to include the first connection terminal 82 and the second connection terminal 83. Similarly, each of the body connectors constituting the body connection section 90 (FIG. 2) may be configured so as not to include the first connection terminal 92 and the second connection terminal 93. Correspondingly, the controller 10 may be simplified so as not to function as the electrical connection detector 15 to thereby skip steps S21 to S22 (FIG. 5).

In addition, in the above-described embodiments, the reference information is stored in the ROMs 86, 860, 861, and 862 included in the replaceable units 8, 800, 801, and 802, respectively. However, the reference information may alternatively be stored in the non-volatile memory included in the controller 10.

The above-described embodiments give examples in which the image forming apparatus according to the present disclosure is applied to the copiers. However, the image forming apparatus according to the present disclosure can be applied not only to a copier, but also to an image forming apparatus including a replaceable unit for performing a specific operation by means of a power source voltage, such as monochromatic copier, scanner, facsimile apparatus, and composite machine having a copying function, a scanning function, a facsimile function, or the like.

According to the present disclosure, it is possible to reduce the risk of damaging a replaceable unit when it is detached, at a low cost.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus comprising:

a notifier for providing a notification;

a power source for generating a power source voltage;

a first replaceable unit for performing a specific operation by means of the power source voltage;

a first body connector for allowing the first replaceable unit to be detachably connected thereto, the first body connector including a body power terminal connected to the power source;

a power supply switch for turning on and off supply of the power source voltage from the power source to the body power terminal; and a power supply controller for controlling operations of the power supply switch and the notifier, wherein the first replaceable unit includes a unit connector to be detachably connected to the first body connector, and an operation portion for performing the specific operation by means of the power source voltage, wherein the unit connector includes a unit power terminal to be connected to the body power terminal for supplying the power voltage to the operation portion, a unit signal terminal, and first and second unit connection terminals to be connected electrically to each other, wherein the unit power terminal, the first and second unit connection terminals and the unit signal terminal are arranged side by side so that in the unit power terminal and the unit signal terminal are provided as both end terminals of the unit connector, and so that the first and second unit connection terminals are between the unit power terminal and the unit signal terminal, wherein the body power terminal has a first end connected to the unit power terminal and a second end connected to the power source through the power supply switch, wherein the first body connector further includes a body signal terminal to be connected to the unit signal terminal, a first body connection terminal to be connected to the first unit connection terminal, and a second body connection terminal to be connected to the second unit connection terminal, wherein the body power terminal, the first and second body connection terminals and the body signal terminal are arranged side by side so that the body power terminal and the body signal terminal are provided as both end terminals of the first body connector, and so that the first and second body connection terminals are between the body power terminal and the body signal terminal, wherein the image forming apparatus further includes:

a history information storage for storing history information relating to a history of execution of the specific operation by the operation portion in association with the operation portion;

a reference information storage for storing reference information serving as a reference for determining whether the operation portion associated with the history information needs to be replaced on the basis of the history information;

an electrical connection detector for detecting whether there is an electrical connection between the first body connection terminal and the second body connection terminal;

a second replaceable unit having the same configuration as the first replaceable unit for performing a specific operation by means of the power source voltage;

a second body connector having the same configuration as the first body connector for allowing the second replaceable unit to be connected detachably thereto, a detection wire having a first end connected to the power source through a resistor and a second end connected to the electrical connection detector;

a wire connecting the second body connection terminal of the first body connector to a first body connection terminal of the second body connector; and a detachment necessity determiner for determining whether the first replaceable unit needs to be detached for replacement on the basis of the history information and the reference information; and wherein the first body connection terminal of the first body connector has a first end connected to the first unit connection terminal and a second end connected to the detection wire, wherein the second body connector has a second body connection terminal with a first end connected to ground and a second end connected to the unit connector, wherein the electrical connection detector measures a voltage value of a voltage impressed to the detection wire from the power source through the resistor and subsequently determines whether the measured voltage value is less than a predetermined reference voltage value on the basis of which the electrical connection detector detects whether the first body connection terminal of the first body connector and the second body connection terminal of the second body connector are connected electrically;

wherein the power supply switch turns on and off supply of the power source voltage from the power source to all of the body power terminals included in the first and second body connectors, wherein when the detachment necessity determiner determines that one of the first and the second replaceable units needs to be detached for replacement, the power supply controller causes the power supply switch to turn off supply of the power source voltage from the power source to all of the body power terminals included in the first and the second body connectors, and subsequently causes the notifier to provide a notification recommending replacement of the first replaceable unit, the notification including information representing that it is time to replace the one of the first and the second replaceable units determined necessary to be detached, and when the electrical connection detector detects the electrical connection, the power supply controller causes the power supply switch to turn on supply of the power source voltage from the power source to all of the body power terminals included in the first and second body connectors.

2. An image forming apparatus according to claim 1, further comprising:

a plurality of third replaceable units each having the same configuration as that of the first replaceable unit for performing a specific operation by means of the power source voltage;

a plurality of third body connectors each having the same configuration as that of the first body connector for allowing each of the plurality of third replaceable units to be detachably connected thereto, one of the plurality of third body connectors being connected to another one of the plurality of third body connectors with a second body connection terminal of the one of the plurality of third body connectors being connected to a first body connection terminal of the another one of the plurality of third body connectors, excluding a particular one of the plurality of third body connectors that is disposed adjacently to the second body connector;

a first wire connecting the second body connection terminal of the first body connector to a first body connection terminal of another particular one of the plurality of third body connectors that is disposed adjacently to the first body connector; and a second wire connecting a first body connection terminal of the second body connector to a second body connection terminal of the particular one of the plurality of third body connectors that is disposed adjacently to the second body connector, wherein the power supply switch turns on and off supply of the power source voltage from the power source to all of the body power terminals included in the first, the second, and the plurality of third body connectors, wherein the detachment necessity determiner determines whether each of the first, the second, and the plurality of third replaceable units needs to be detached for replacement, wherein the electrical connection detector detects whether there is an electrical connection between the first body connection terminal of the first body connector and a second body connection terminal of the second body connector, wherein when the detachment necessity determiner determines that any one of the first, the second, and the plurality of third replaceable units needs to be detached for replacement, the power supply controller causes the power supply switch to turn off supply of the power source voltage from the power source to all of the body power terminals included in the first, the second, and the plurality of third body connectors, and subsequently causes the notifier to provide a notification recommending replacement of the one of the first, the second, and the plurality of third replaceable units determined necessary to be detached, the notification including information representing that it is time to replace one of the first, the second and the plurality of third replaceable units determined to be necessary to be detached, and wherein when the electrical connection detector detects the electrical connection, the power supply controller causes the power supply switch to turn on supply of the power source voltage from the power source to all of the body power terminals included in the first, the second, and the plurality of third body connectors.

3. An image forming apparatus according to claim 1, further comprising:

a third replaceable unit each having the same configuration as that of the first replaceable unit for performing a specific operation by means of the power source voltage;

a third body connector having the same configuration as that of the first body connector for allowing the third replaceable unit to be detachably connected thereto;

a first wire connecting the second body connection terminal of the first body connector to a first body connection terminal of the third body connector; and a second wire connecting a second body connection terminal of the third body connector to a first body connection terminal of the second body connector, wherein the power supply switch turns on and off supply of the power source voltage from the power source to all of the body power terminals included in the first, the second, and the third body connectors for replacement, wherein the detachment necessity determiner determines whether each of the first, the second, and the third replaceable units needs to be detached, wherein the electrical connection detector detects whether there is an electrical connection between the first body connection terminal of the first body connector and a second body connection terminal of the second body connector, wherein when the detachment necessity determiner determines that any one of the first, the second, and the third replaceable units needs to be detached for replacement, the power supply controller causes the power supply switch to turn off supply of the power source voltage from the power source to all of the body power terminals included in the first, the second, and the third body connectors, and subsequently causes the notifier to provide a notification recommending replacement of the one of the first, the second, and the third replaceable units determined necessary to be detached, the notification including information representing that it is time to replace one of the first, the second and the third replaceable units determined to be necessary to be detached, and wherein when the electrical connection detector detects the electrical connection, the power supply controller causes the power supply switch to turn on supply of the power source voltage from the power source to all of the body power terminals included in the first, the second, and the third body connectors.

4. An image forming apparatus according to claim 1, further comprising:

an abnormality detector for detecting an abnormality that requires detachment of the first replaceable unit to be eliminated, wherein when the abnormality detector detects the abnormality, the detachment necessity determiner determines that the first replaceable unit needs to be detached for replacement.

* * * * *